US005988798A

United States Patent [19]

Hirasawa et al.

[11] Patent Number: 5,988,798

[45] **Date of Patent: *Nov. 23, 1999**

[54] FLUID EJECTION HEAD WITH MULTI-DIMENSIONAL FLUID PATH

[75] Inventors: Shin'ichi Hirasawa, Sagamihara; Yasuyuki Tamura; Hiroto Takahashi, both of Yokohama; Makoto Shioya, Tokyo; Masayoshi Tachihara, Chofu; Hiroyuki Maeda; Genji Inada, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/580,041

[22] Filed: Dec. 20, 1995

Related U.S. Application Data

[63] Continuation of application No. 08/178,367, Jan. 6, 1994, abandoned, which is a continuation of application No. 07/821,066, Jan. 16, 1992, abandoned.

[30] Foreign Application Priority Data

Jan. 17, 1991 [JP] Japan ..... 3-004067

[51] Int. Cl.[6] ..... B41J 2/05

[52] U.S. Cl. ..... 347/65; 347/62

[58] Field of Search ..... 347/65, 63, 62, 347/56

[56] References Cited

U.S. PATENT DOCUMENTS

| | | | |
|---|---|---|---|
| 4,317,124 | 2/1982 | Shirato et al. | 347/67 |
| 4,338,611 | 7/1982 | Eida | 347/63 |
| 4,345,262 | 8/1982 | Shirato | 347/57 |
| 4,394,670 | 7/1983 | Sugitani et al. | 347/65 |
| 4,410,899 | 10/1983 | Haruta et al. | 347/56 |
| 4,417,251 | 11/1983 | Sugitani | 347/65 |
| 4,752,787 | 6/1988 | Matsumoto | 347/65 |
| 4,897,674 | 1/1990 | Hirasawa | 347/65 |
| 5,159,354 | 10/1992 | Hirasawa | 347/65 |

FOREIGN PATENT DOCUMENTS

| | | | |
|---|---|---|---|
| 0294631 | 12/1988 | European Pat. Off. | B41J 3/04 |
| 0439633 | 8/1991 | European Pat. Off. | B41J 2/14 |
| 55-109669 | 8/1980 | Japan . | |
| 56-139970 | 10/1981 | Japan . | |
| 59-138460 | 8/1984 | Japan . | |
| 60-008074 | 1/1985 | Japan . | |
| 60-204352 | 10/1985 | Japan . | |
| 62-59672 | 3/1987 | Japan . | |
| 63-280650 | 11/1988 | Japan . | |
| 187356 | 3/1989 | Japan . | |
| 1195050 | 8/1989 | Japan . | |
| 1-255551 | 10/1989 | Japan . | |

OTHER PUBLICATIONS

Communication in Eur. Pat. Appln. 92300352.9–2399.

*Primary Examiner*—Joseph Hartary

*Attorney, Agent, or Firm*—Fitzpatrick, Cella, Harper & Scinto

[57] ABSTRACT

A fluid ejection head comprises a heater disposed in a fluid path. A bubble is generated by supplying electric power to the heater, and ink is ejected in a direction substantially parallel to a face of the heater. The fluid path is shaped to have a first part with a constant-sectional area adjacent to an ejection orifice a second part located behind the first part and containing the heater. The cross-sectional area of the second part increases by twice as large as the cross-sectional area of the ejection orifice, a length (A) between an end of the first part of the fluid path and a top end of the heater is greater than or equal to half of the height Ph of the ejection orifice, and a shortest gap between the ejection orifice and the heater is less than or equal to a sum of a half of the height Ph of the ejection orifice and a length (L) of the first part of the fluid path.

10 Claims, 13 Drawing Sheets

FLUID EJECTION HEAD WITH MULTI-DIMENSIONAL FLUID PATH

This application is a continuation of application Ser. No. 08/178,367, filed Jan. 6, 1994, now abandoned, which was continuation of application Ser. No. 07/821,066, filed Jan. 16, 1992, now abandoned.

BACKGROUND OF THE INVENTION

1. Field of the Invention

The present invention relates to a fluid ejection head for ejecting fluid by thermal energy and a fluid ejection recording apparatus using this fluid ejection head. This invention can be applicable to an apparatus for ejecting fluid for various and is purposes especially preferable for use in a printer and its application apparatus.

2. Description of the Prior Art

Many technical papers and articles on fluid ejecting technologies using thermal energy are found in the field of recording information on a recording medium. In recording information by ejecting fluid by using thermal energy, for example, an electric resistance element is used as means for generating energy for ejecting fluid. The electric resistance element defines a heat applying face which directly or indirectly applies thermal energy to fluid. By applying thermal energy to fluid in a short period of time, film boiling occurs in fluid and a bubble caused by this film boiling grows. And hence, a pressure wave induced by this bubble growing pushes fluid outside an ejection orifice so as to record images on a recording media.

In the recording method by ejecting ink fluid, as a plurality of ejection orifices for ejecting fluid for recording can be arranged in high density, expected are various advantages such as attaining the high resolution images on a recording medium and making the recording head in a small-sized element.

However, in trying to arrange a plurality of ejection orifices with fine intervals, it is required that the size of the cross section of a fluid paths should be taken to be small enough. In this case, as the impedance and the inertance of the fluid path may be high, the refill time after ejecting ink fluid, the time defined for refilling fresh ink fluid again in the fluid path from the supply port and forming a meniscus near the ejection orifice is getting longer, and this creates an obstacle for attaining high speed recording.

In Japanese Patent Application Laid-open No. 204,352/1985, disclosed is an ink jet recording head where a fluid resistor for reducing the amount of fluid flowing back to a supply port side is installed in the fluid path between the electric resistance element and the supply port in order to make fluid ejection operations stable. In this prior art, it may be difficult to fabricate an ink jet recording head having a complex structure including the fluid resistor and to control the fluid flow precisely, and distinguished advantages cannot be expected.

In Japanese Patent Application Laid-open No. 87,356/1989, disclosed is an ink jet recording head where the cross-section of the fluid path in the perpendicular direction to the fluid flow is increased as it goes to the ejection orifice in order to use kinetic energy of the above mentioned bubble efficiently to be converted for ejecting ink fluid. And furthermore, in Japanese Patent Application Laid-open No. 195,050/1989, which corresponds to U.S. Pat. No. 4,752,787, an embodiment of a fluid path is disclosed where the height of the fluid path near the thermal energy supplying part, that is, the electric resistance element, is relatively higher than other parts of the fluid path so that the fluid path may not be plugged by the bubbles, which is also one embodiment of the invention disclosed in Japanese Patent Application Laid-open No. 139,970/1981, which corresponds to U.S. Pat. No. 4,410,899. In case, however, only a single objective is set forth it does not further increase combinational effects.

U.S. Pat. No. 4,752,787, discloses a structure of the fluid path, the cross-section of which increases in the direction toward the common fluid reservoir in order to increase refilling performances, the relative difference of fluid impedance increases and the location of developing the bubble by thermal energy is shifted to the common fluid reservoir. This contradicts the objective of making the fluid path shorter.

In Japanese Patent Application Publication No. 59,672/1987 which corresponds to U.S. Pat. No. 4,417,251, a wall covering around the electric resistance element generating thermal energy is formed by a hard layer made of photosensitive resin materials. This invention advances the reduction of friction loss between the wall and the fluid.

In Japanese Patent Application Laid-open No. 109,669/1980, which corresponds to U.S. Pat. No. 4,410,899 disclosed is use of an element for generating thermal energy and that large-grained sludges in ink fluid are trapped by forming a coupling part with its cross-section less than or equal to the cross-section of the ejection orifice in the fluid path. In this invention, many modifications of shapes of the fluid path are described in detail, but the relative position of the electric resistance element in the fluid path is not described at all. According to drawings of this gazette, it may be understood that the electric resistance element may be located in the region of the fluid path where the cross-section is reduced toward the ejection orifice.

So far, there are many prior arts which disclose the structure of the fluid path and the layout of heat generation elements such as a heater or an electric resistance element, but none of them refers to altering the fluid ejection operations.

DESCRIPTION OF THE BACKGROUND ART

The present invention attempts to attain a higher quality of recorded images, the higher stability in ejecting fluid and a higher speed in recording images by using fluid ejecting heads. The present invention is based on the following considerations.

In order to record fine images at higher speeds, it is required that the number of orifices and electric resistance elements for ejecting fluid be increased and that the electric resistance elements should be driven by higher frequency driving signals. However, if the number of orifices is increased and the electric resistance elements are driven by higher frequency driving signals, the power consumption of the recording head increases and the temperature of the recording head also increases remarkably. In such a case, the temperature of the recording head may deviate and uniformly recorded images cannot be obtained, and in the worst case ink fluid may not be ejected from the orifice.

In order to drive the recording head at a higher frequency, it is required that a bubble and ink fluid in the fluid path should move quickly in response to a driving pressure applied to the ink fluid. After a designated amount of ink fluid is ejected from the orifice, the bubble should be diminished quickly and the front of the ink fluid, that is, the meniscus, should moved up to the orifice again in order to prepare the ejecting ink fluid for the next cycle. In order to make the period for this refilling ink fluid shorter, the size of the heater (electric resistance element) and the power supplied to the heater should be reduced. More specifically, if the size of the bubble and its kinetic energy is small, the time spent until the bubble is diminished will be shortened and the movement of ink fluid in the fluid path toward the back of the orifice may be reduced, which leads to reduction of the backward displacement of the meniscus, and hence, the time period or refilling ink fluid again can be reduced.

In case that the size of the heater and the power supplied to the heater are reduced, however, the ejection speed of ink fluid and the volume of the ink fluid ejected are reduced. In this case, there may be problems that the ejection operation is unstable and fails due to outer turbulent forces and that the ejecting direction is not fixed. And also, as the volume of the ink fluid ejected is small, the printing density of recorded images is lowered.

SUMMARY OF THE INVENTION

The object of the present invention is to provide the structure of a fluid path for supplying an adequate volume of ejected ink fluid with ejecting speed being maintained high enough by using a relatively small heater. Owing to this structure, it may be possible that a recording head having a plurality of fluid paths arranged in a higher density is driven by the higher frequency signals, which was impossible in prior arts.

Another object of the present invention is to provide a fluid ejection head without complex additive mechanisms which satisfies the above-mentioned, sometimes contradicting, and to provide a recording apparatus using the fluid ejection head above.

Another object of the present invention is to provide a fluid ejection head and a recording apparatus which is effective in case of forming an ejection orifice by an end part of the fluid ejection head.

In the first aspect of the present invention, a fluid ejection head comprises:

a plurality of ejection orifices;

a plurality a fluid paths each of which is disposed corresponding to each of the plurality of ejection orifices and is connected to the ejection orifice, respectively;

a common fluid reservoir for storing fluid to be supplied to the fluid path, the common fluid reservoir connecting to the plurality of fluid paths; and a plurality of electric resistance elements each of which is disposed in one of the plurality of fluid paths and is shaped in a plane for defining a thermal apply face for forming a bubble by giving thermal energy to fluid in the fluid path and inducing film boiling in the fluid, wherein each of the plurality of fluid paths further comprises:

a first path part having a cross-section area equivalent to a cross-section area of the ejection orifice corresponding to each fluid path and being adjacent to the ejection orifice;

a second path part continuously adjacent to the first path part and having a cross-section area increasing continuously from the cross-section area equivalent to the cross-section of the first path part toward the common fluid reservoir;

a third path part adjacent to the second path part, having a constant cross-section area and including at least a part of the electric resistance element; and a fourth path part adjacent to the third path part, including a part having a cross-section area decreasing from the cross-section area equivalent to the cross-section area of the third path part toward the common fluid reservoir, and connecting to the common fluid reservoir.

The first and second path parts can be connected by a curved first contacting part, and the second and third path parts by a curved second contacting part.

With this fluid ejection head, it will be appreciated that the kinetic energy or a bubble generated by film boiling is most effectively utilized and that relatively high quality recorded images can be obtained stably with a small amount of ejected fluid.

In the second aspect of the present invention, an ink jet recording head comprises:

a heater having a face within a fluid path, wherein a bubble is generated by supplying electric power to the heater, and ink is ejected almost in a direction parallel to the face of the heater, the fluid path further comprising:

a first part having a constant cross-section area being adjacent to an ejection orifice;

a second part behind the first part containing the heater, the cross-section area of the second part increasing by twice as large as the cross-section area of the ejection orifice;

a length A between an end of the first part and a top end of the heater is greater than or equal to half of a height Ph of the ejection orifice; and a shortest gap between the ejection orifice and the heater is less than or equal to a sum of a half of the height Ph of the ejection orifice and a length of the first part.

With this invention, an optimal amount of ejected ink fluid is regulated with less energy.

In order to obtain the optimal amount of ink fluid with less energy, a structure with the distance between the heater and the ejection orifice being shortened can be considered. In this case, the bubble is not broken in its development phase but may be broken in its diminishing phase. In this case, the occurrence of a broken bubble is once in 100 to 1000 times. When the bubble remains in the fluid path, the ejecting speed is reduced to be a half of the normal speed. So far, in the existence of the residual bubble in the fluid path, the high and stable ejecting speed cannot be obtained eventually. This phenomena can be explained in the following way. In the case when the length between the heater and the ejection orifice is short, when the meniscus goes inside the orifice as the bubble diminishes, as the amount of ink fluid between the meniscus and the bubble is small, ink fluid between the meniscus and the bubble is rapidly attracted into the bubble and the bubble catches outer air through open channels at the meniscus, and so far, the bubble is not broken. In this invention, the cross-section of the fluid path between the orifice and the heater is extended two times as large as that of the orifice, and hence, the movement of the bubble in the width direction in the fluid path is established as well as in direction in which the meniscus moves in order to maintain the enough thickness of ink fluid between the meniscus and the bubble.

On the other hand, in case that, near the orifice, the wall of the fluid path is not parallel to the direction in which ink fluid is ejected, the ejecting direction may be unstable. Owing to dimensional errors in fabricating heads, the size and the orientation of the orifice may not be maintained to be constant. In this invention, these problems can be solved by marking a part of the fluid path which is adjacent to the ejection orifice to have a constant cross-section area. The preferable length of this part with a constant cross-section area is practically greater than about a quarter of the width and the height of the ejection orifice.

In the above-mentioned structure of the head, estimated is that ink fluid can be stably ejected if the length between the back end of the part with its cross-section area being constant and the top of the heater (electric resistance element) is greater than or equal to half of the height of the ejection orifice. This can be concluded by the following reason. As the size of the bubble is diminished on the heater, the shape of the ink fluid between the meniscus and the bubble is symmetrical with respect to the width direction of the fluid path and mechanical stability in this direction is established, but the shape of the ink fluid between the meniscus and the bubble is not symmetrical with respect to the height direction of the ink fluid path and its stability is not established. So far, stability is determined by the relation of the length between the back end of the part with its cross-section area being constant and the front end of the heater to the height of the ejection orifice rather than the width or the ejection orifice.

If the length between the ejection orifice and the heater is extended, the ejecting speed is reduced in response to the extension of this length and the ejecting speed is inversely proportional to the length between the ejection orifice and the heater. Therefore, if the length between the ejection orifice and the heater is extended more than two times as long as the minimum length with which a stable fluid ejection is guaranteed, the ejection speed cannot be increased enough in comparison with the above-mentioned ejection speed in case that ejection operations are unstable. However, this structure has the advantage of making stable the ejecting speed and the ejection fluid volume.

It is further preferable to consider an optimum size of the heater. Experimentally estimated to be adequate is that the size of the heater is between a half of the cross-section of the ejection orifice and three times as large as the cross-section of the ejection orifice. In case that the size of the heater is too small, as the ejecting speed is extremely low, the ejection operation becomes unstable. In case that the size of heater is too large, ejected liquid drops are spattered on a recording medium and recorded images may be stained. In order to prevent these problems, it is an important condition that the size of the heater is between a half of the cross-section of the ejection orifice and three times as large as the cross-section of the ejection orifice.

In the third aspect of the present invention, an ink jet recording head as described above has an area of the heater greater than or equal to a half of the cross-section area of the ejection orifice and less than or equal to three times the cross-section area of the ejection orifice.

According to the invention, it will be appreciated that an efficient use of ejecting energy is attained and that an optimal fluid ejection operation can be stably established with the least amount of energy supplied to the heater. Especially in fabricating these kinds of heads, this invention is valid for cutting a single substrate into a plurality of with, each piece used for a single head. In practical use, the distance between the heater and the ejection orifice is about between some tens $\mu$m and one hundred and some tens $\mu$m, and the dimensional errors such as some 10 $\mu$m in fabricating heads by cutting a substrate may give an effect over the fluid impedance between the heater and the ejection orifice which cannot be negligible. This invention provide a head and an apparatus which is not subject to the above-mentioned dimensional errors in fabricating process and which has a lower impedance in fluid flow in the fluid path.

BRIEF DESCRIPTION OF THE DRAWINGS

Embodiments of the invention will now be described, by way of example and with reference to the accompanying drawings in which.

Figure 1:
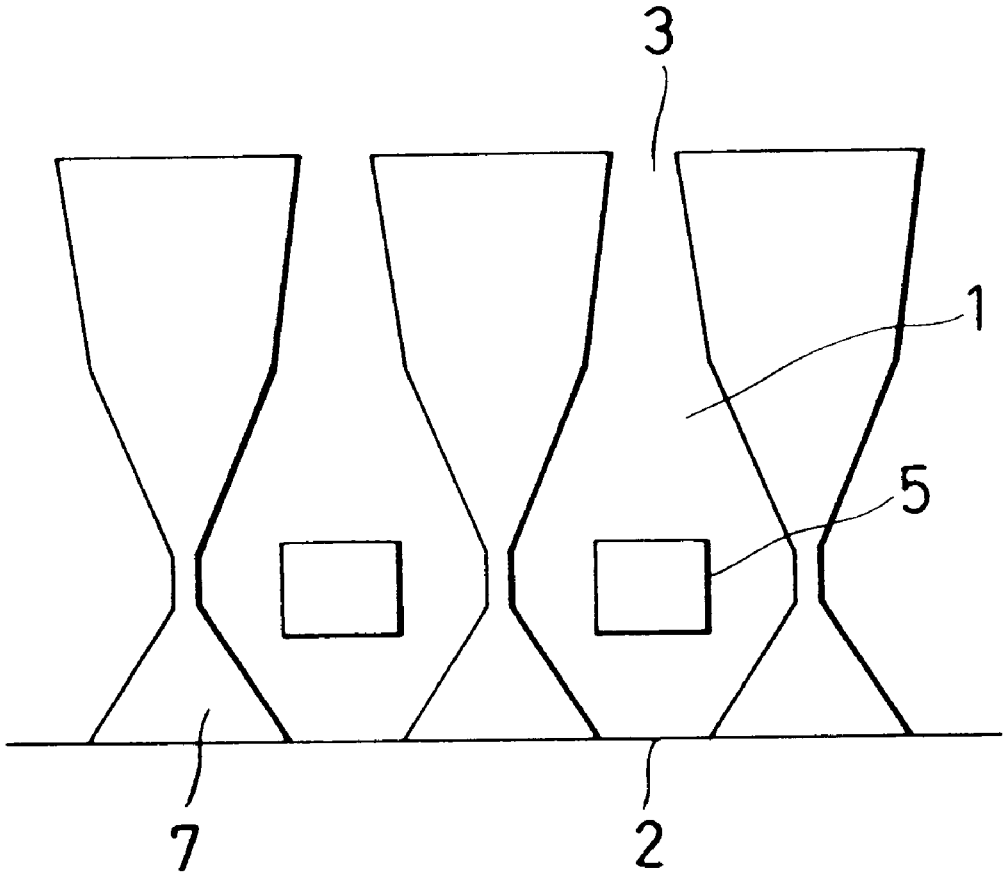
FIG. 1 is a plan view or a fluid path part of a fluid ejection head of a first embodiment of the present invention.

As will be described, these and other features of the present invention and one embodiment of it are more fully described below in the detailed description and with the accompanying drawings.

DETAILED DESCRIPTION OF PREFERRED EMBODIMENTS

At first, a principle underlying each of the embodiments of the present invention to be described later will be explained below.

A structure of a fluid path of a fluid ejection head is so determined that the amount of ink fluid to be projected and its ejection speed may be equal to preferable predetermined values by adjusting parameters such as the size and the position of an electric resistance elements formed in a plane geometry, thermal energy generated, the fluid resistance of the fluid path, the size and the shape of an ejection orifices and so on. There may be a case that above-mentioned parameters cannot be determined optimally because of several physical restrictions on the head fabrication process and geometrical restrictions on the shape and the size of elements. If there is no such restriction, the size of the fluid path may be taken to be wider in its width and height and shorter in its length, which can be so determined that the smaller the fluid resistance of the fluid path, that is, impedance or inertance, the higher the fluid path efficiency is, and furthermore, adjusting the size and the position of the electric resistance element and the size and the shape of the ejection orifice, the amount of fluid and its ejection speed can be obtained to be equal to the predetermined values. However, in case of a fluid ejection head having a plurality of ejection orifices in a single head, the width of the fluid path is limited within an allowable value because of an existence of a separation wail between adjacent fluid paths, and the thickness of the separation wall is required to be large enough to establish mechanical strength in the head assembly. So far, in forming actual fluid ejection heads, various kinds of physical restrictions should be considered.

The present invention uses the directional changes in the fluid path impedance and the dependency of the amount of fluid on the fluid path impedance. More specifically, though the objective of the present invention is still defined as minimizing the overall impedance of the fluid path. In the present invention, the impedance of the fluid path may be changed to be different values when ejecting fluid from the ejection orifices and supplying fluid to the fluid path, that is, the directional changes in the fluid path impedance and the dependency of the amount of fluid on the fluid path impedance which lead to a higher efficiency in ejecting fluid and refilling fluid.

In order to state the directional changes in the fluid path impedance and the dependency of the amount of fluid on the fluid path impedance, the fluid path impedance is defined at two regions; one between the electric resistance element and the election orifice, which is referred as a forward side, the other between the fluid supply port and the electric resistance element, which is referred as a backward side. In ejecting fluid, fluid can be ejected efficiently from the ejection orifice if fluid can be easily moved in the forward side and prevented from moving in the backward side. This is achieved by defining the fluid path impedance in the forward side to be less than the fluid path impedance in the backward side. On the other hand, in supplying fluid to the fluid path, it is required that fluid can be easily moved in both the forward side and the backward side because a meniscus of the fluid which is backed after ejecting fluid should be recovered to a normal position near the ejection orifice. That is, the fluid path impedance is required to be reduced in both the forward side and the backward side. So far, in order to establish efficient fluid ejecting and refilling, the fluid path impedance defined in the forward side is required to be always smaller and the fluid path impedance defined in the backward side is required to be greater in ejecting fluid and to be smaller in supplying ink fluid for refilling. Thus, the fluid path impedance in the backward side is required to have contradictory properties in response to different cases.

To adjust the length and the width of the fluid path is an effective method for changing the fluid path impedance. The present invention emphasizes the adjustment of the width of the fluid path. In general, the fluid path impedance decreases as the width of the fluid path increases and the fluid path impedance increases as the width of the fluid path decreases. As described earlier, it is preferably concluded that the width of the forward side of the fluid path is determined to be large and the width of the backward side of the fluid path is determined to be smaller in ejecting fluid and to be larger in supplying ink fluid, which contradict each other. This contradiction may be resolved by considering the fluid behaviors in ejecting and supplying fluid.

In this invention, noticed is the difference between the time spent in ejecting fluid and the time spent in supplying ink fluid. As the time spent in ejecting fluid is shorter than that in supplying fluid, the flow rate of ejected fluid is relatively higher than the flow rate of supplied fluid. By using the difference in the flow rate and by forming an adequate structure of the fluid path, realized are the directional changes in the fluid path impedance and the dependency of the amount of fluid on the fluid path impedance.

At first, the structure of the backward side of the fluid path is described. According to the structure of the fluid path of the present invention, a tapered tube is used as the fluid path between the electric resistance element and the fluid supply port and the cross-section area is gradually reduced from the center line of the electric resistance element to the fluid supply port. The center line of the electric resistance element can be closer to the orifice than the middle of the third path part. The path can include a fluid leading part having a constant cross-sectional area between the fluid supply port and the tapered tube. In this structure, in ejecting fluid, the fluid flow directing to the backward side is blocked. In comparison with a fluid path with its cross-section being constant, the tapered fluid path brings a greater impedance for a fluid flow directing to fluid supply port, and hence an efficient fluid ejection can be established. On the other hand, in supplying fluid, the fluid flow is defined from the fluid supply port to the electric resistance element where the cross-section area increases as the fluid flow goes and its flow rate is relatively low and therefore, the impedance for this fluid flow is reduced so as to establish an efficient fluid supply flow.

Next, the structure of the forward side of the fluid path will be described. In the forward side of the fluid path, in both ejecting fluid and supplying fluid, the fluid flow is defined from the electric resistance element to the ejection orifice. Therefore, in order to obtain an efficient fluid flow, it may be allowed that the structure of the fluid path is shaped in a diffuser tube where the cross-section area increases towards the ejection orifice from the electric resistance element.

According to the above description, the whole structure of the fluid path is so defined to be a diffusion tube with its cross-section area increasing from the fluid supply port towards the ejection orifice so that the fluid flow may be established efficiently. However, as the forward side of the fluid path has some important functions such as controlling the amount of ejected fluid and its ejecting speed, the structure of the forward side of the fluid path cannot be determined only by the factors considering the efficiency in ejecting fluid. In addition, in the above-mentioned structure of the fluid path shaped in a diffusion tube, down-sizing of the fluid path and multiplying ejection orifices in order to obtain a higher density recording cannot be established. The present invention gives provides a structure for the forward side of the fluid path to solve the above mentioned problems. In the present invention, the cross-section area of the fluid path from the electric resistance element toward the ejection orifice is reduced in order to control the amount of ejected fluid and the ejecting speed. In this structure, it is preferable that the position where the cross-section area of the fluid path takes a maximum value is designed to be close enough to the ejection orifice, and actually, this maximum position may be located between the ejection orifice and the electric resistance element which generates thermal energy to be transformed to be a pressure wave to eject fluid. According to this structure, it will be appreciated that controlling the amount of ejected fluid and its ejecting speed in desirable values relatively easily by increasing ejecting efficiency and that down-sizing of the fluid path and multiplying ejection orifices can be possible in order to obtain a higher density recording.

More specifically, in the present invention, in the fluid path shaped in a diffusion pipe from the ink fluid supply port toward the electric resistance element, as the position where the cross-section area of the fluid path having its maximum value is located between the center of the electric resistance element and the ejection orifice, the width of the fluid path at the above position can be taken to be a maximum value so as to form an array of multiple ejection orifices. Owing to this structure, the impedance of the overall fluid path can be reduced. In contrast, in a prior art fluid path, as the fluid path is longer and hence the portion where the width of the fluid path takes its maximum value may be extended in a longer range, the thickness of the separation wall between adjacent fluid paths of distinctive ejection orifices cannot be reduced by considering the strength of the separation wall and the effect of bubble pressure in the fluid path on its adjacent fluid paths, and the maximum width of the fluid path should be small enough in comparison with the pitch of the fluid paths. According to the present invention, the fluid ejection head having multiple ejection orifices can be formed in a small unit. In the present invention, the length of the portion where the width of the fluid path takes its maximum value is determined by the material property of the separation wall and the decreasing rate of the width of the fluid path from the ejection orifice to the fluid supply port. Additionally, in the present invention, in the portion where the width of the fluid path takes its maximum value, the distance between the electric resistance element and the separation wall can be taken to be large enough, the bubble can be developed to be a large-sized bubble without being depressed by the separation walls of the fluid path, and higher energy conversion efficiency can be attained when converting kinetic energy of the bubble into fluid ejecting energy.

First Embodiment

FIG. 1 is a plan view of a fluid ejection recording head used for recording information in the first embodiment of the present invention. In the fluid ejection head, by forming a separation wall 7 on a substrate, an ejection orifice 2 and a fluid path 1 are defined. At the same time, an electric resistance element 5 is formed in the fluid path 1 on the substrate. In this embodiment, the length of the fluid path 1 is 200 $\mu$m, and the shape of the electric resistance element 5 is a rectangle of 45 $\mu$m×35 $\mu$m.

In this embodiment, the effect of a fluid path with a wide width, which is one of characteristics of the present invention, is fully used where the widest part of the fluid path is as close as possible to the ejection orifice 2, and the width of the electric resistance element 5 is taken to be larger and the length of the fluid path 1 is taken to be smaller.

The objective of placing the electric resistance element 5 closer to the ejection orifice 2 is to enable a bubble to be developed freely in the width direction of the fluid path 2. In case that the width of the fluid path cannot be taken to be longer as in a prior art fluid ejection head, if the electric resistance element 5 is made to be closer to the ejection orifice 2, there may be such a problem that the ejection performance is lowered because the bubble in the fluid path 1 communicates with atmospheric air. In contrast with prior art, the present invention can prevent this problem. 5 Additionally, in this embodiment, as the distance between the electric resistance element 5 and the ejection orifice 2 is small, ink fluid ejecting operations can be performed with a small-sized electric resistance element, which means that a higher efficiency and energy saving can be attained. This structure also brings an effect over reducing the overall impedance of the fluid path 1, which also leads to a higher efficiency in ejecting ink fluid.

Incidentally, in this embodiment and other embodiments described below, ink fluid (or simply "ink") is used for the fluid ejection head as fluid so that the fluid ejection head can eject ink so as to record information.

Second Embodiment

Figure 2:
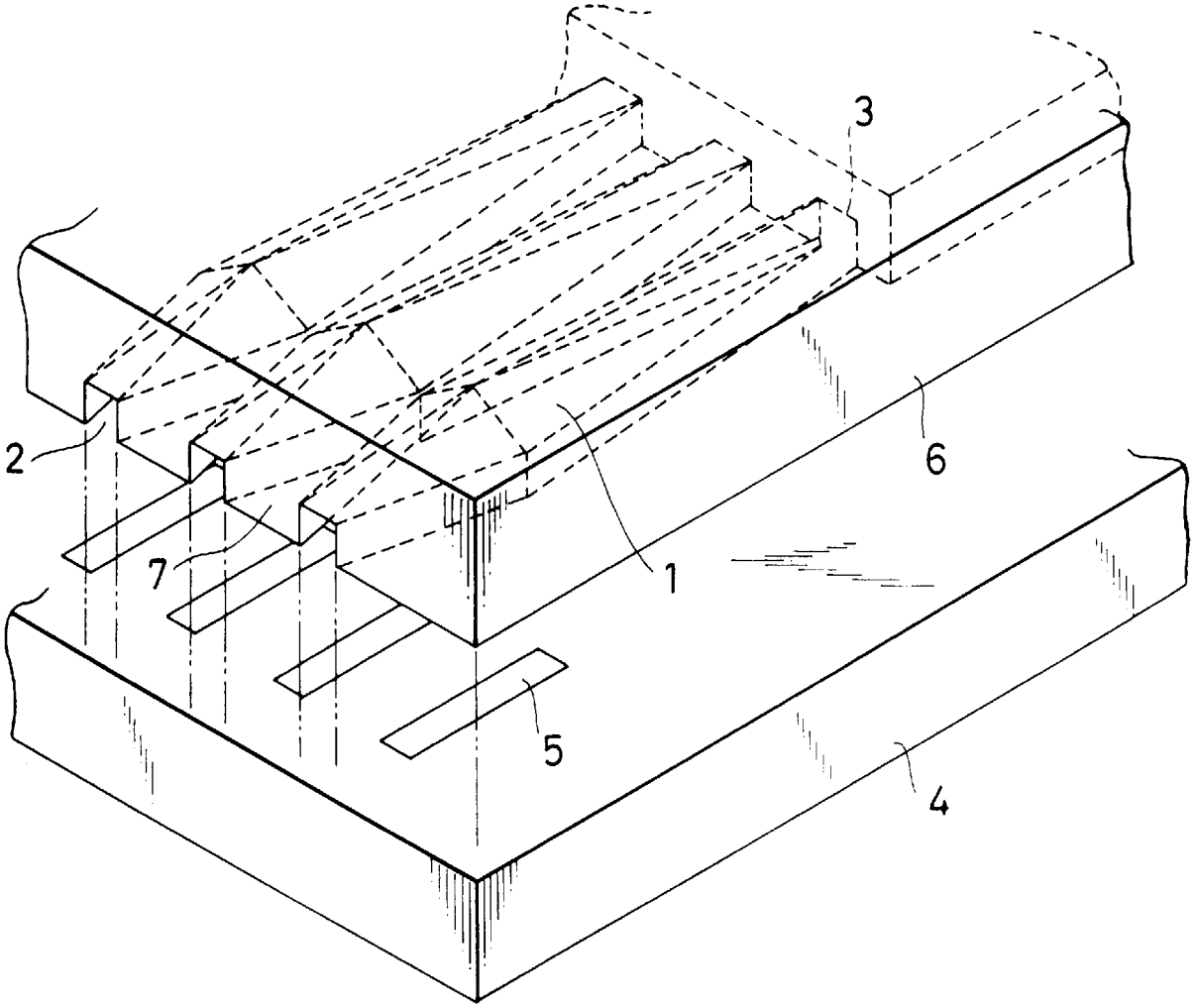
FIG. 2 is a partial perspective view of a fluid ejection head of a second embodiment of the present invention.

As shown in FIG. 2, in second embodiment, a plurality of electric resistance elements 5 are arranged with constant intervals on the substrate 4. Each fluid path 1 is defined by forming a groove at the position corresponding to the electric resistance element 5 on the top plate 6. By bonding the top plate 6 and the substrate 9, a fluid ejection recording head can be obtained. Individual fluid paths 1 are separated with each other by the separation wall 7. The ink fluid to be ejected is supplied from the supply port 3 and ejected from the ejection orifice 2. Almost at the center of the electric resistance element 5, the width of the separation wall 7 is taken to be almost zero in order to make the width of the fluid path maximized, and also by making the height of the fluid path maximized, the cross-section area of the fluid path can be maximized. In the second embodiment, the area of the ejection orifice is 35 $\mu$m×35 $\mu$m and the maximum height of the fluid path is 60 $\mu$m.

Figure 3A:
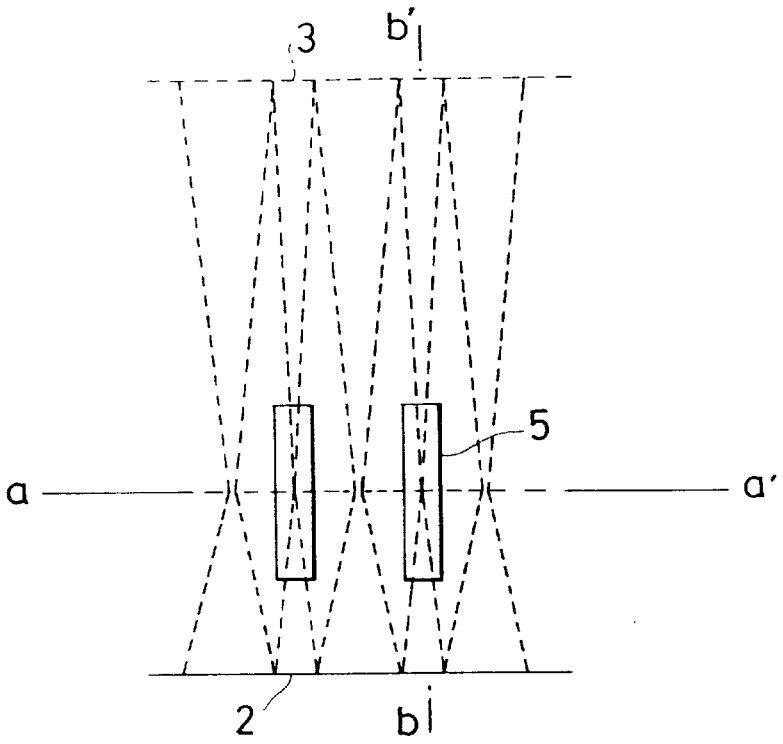
FIGS. 3A, 3B and 3C are a plan view, a cross-sectional view taken along line a-'a' and a cross-sectional view taken along line b-'b' of the fluid path part shown in FIG. 2, respectively.
Figure 3B:
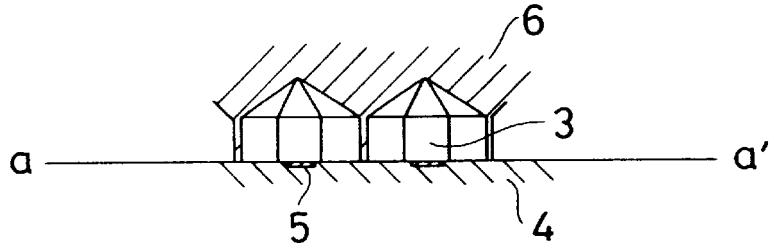
Figure 3C:
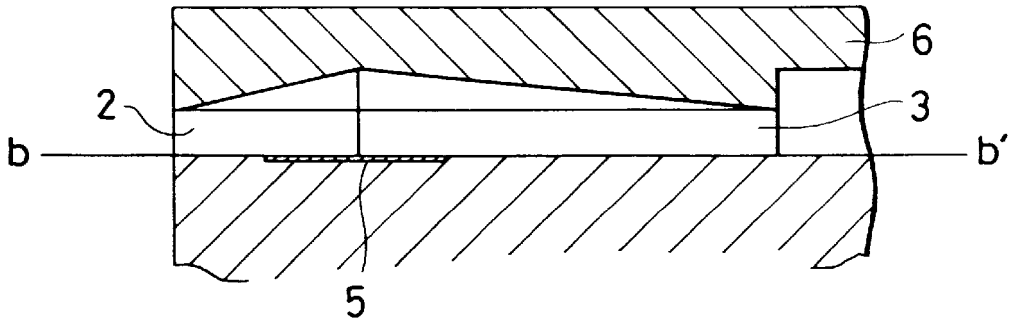

FIG. 3A is a plan view of the fluid path part of the second embodiment of the present invention, FIG. 33 is a cross-sectional view taken along line a-a' in FIG. 3A and FIG. 3C is a cross-sectional view taken along line b-b' in FIG. 3A.

TABLE 1

| | amount of ejected ink × $10^{-9}$CC | ejection speed m/s | time spend for refilling $\mu$ sec |
|---|---|---|---|
| first embodiment | 130 | 14 | 222 |
| second embodiment | 136 | 13 | 250 |

Table 1 shows characteristics of fluid ejection recording heads of the first and second embodiments of the present invention. As found in Table 1, the fluid ejection heads of these embodiments have good characteristics.

Third Embodiment

Figure 4:
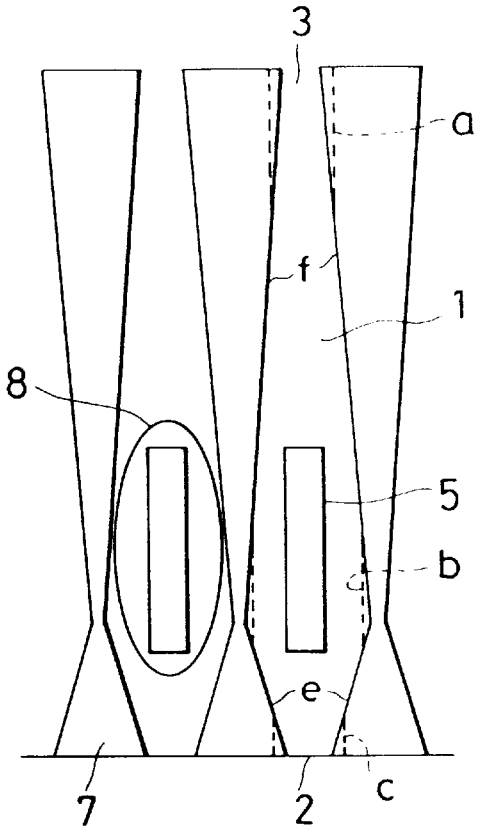
FIG. 4 is a plan view of a fluid path part of a fluid ejection head of a third embodiment of the present invention.

FIG. 4 is a plan view of a fluid path part of a fluid ejection recording head of the third embodiment. That is, FIG. 4 shows an embodiment where the portion of the fluid path 1 where the width of the fluid path takes its maximum value is further displaced from the center of the electric resistance element 5 towards the ejection orifice. Owing to this structure, the growth of a bubble 8 can be enhanced near the ejection orifice 2 and a higher ink fluid ejection efficiency can be attained.

In the following embodiments, the portion of the fluid path 1 where the width of the fluid path takes its maximum value is further displaced from the center of the electric resistance element 5 towards the ejection orifice. In addition, in the structure of the third embodiment of the present invention, similar to embodiment shown in FIG. 3, it allows the height of the fluid path to be maximized at the position where the width of the fluid path takes its maximum value.

As shown by broken lines a, b and c in FIG. 4, the structure of the fluid path 1 can be allowed to be shaped in one of these broken lines or any combination of these broken lines. Especially in the structure using broken lines b, as described in the following embodiments, the initial phase of forming the bubble can be stabilized owing to the preferable shape of the fluid path. In this case, a portion of the fluid path having a maximized width is extended along with the electric resistance element, and the growth of the bubble in this portion can be achieved uniformly. In the structure using broken lines c, the ejecting speed can be stabilized owing to the preferable shape of the fluid path.

Fourth Embodiment

Figure 5:
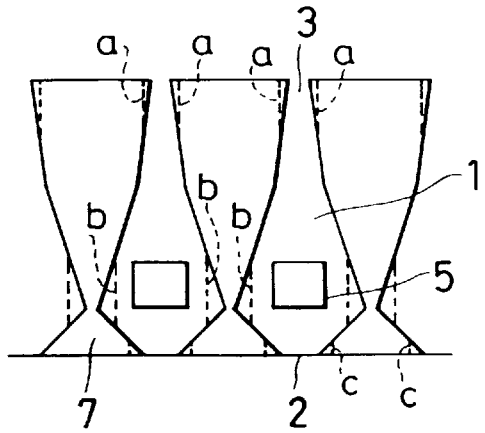
FIG. 5 is a plan view of a fluid path part of a fourth embodiment of the present invention.

FIG. 5 is a modification example of the first embodiment of the present invention, showing a plan view of a fluid path similar to FIG. 1. In this embodiment, the portion of the fluid path 1 where the width of the fluid path takes its maximum value is further displaced towards the ejection orifice 2 in comparison with the first embodiment.

In FIGS. 1 and 5, the width of the electric resistance element 5 is larger than the width of the electric resistance element 5 of the embodiment shown in FIG. 4, which is larger than the length of the electric resistance element 5 in the direction in which ink flows of FIGS. 1 and 5. Owing to this structure, the growth of the bubble in the width direction of the fluid path can be fully established and ink fluid between the electric resistance element 5 and the ejection orifice can be ejected promptly and completely as well as ink refilling performance can be increased. In addition to this structure, by shaping the fluid path in the broken line b in FIG. 5, the above mentioned advantages can be further ensured.

As the width of the ejection orifice of the embodiments shown in FIGS. 1 and 5 is less than the width of the electric resistance element 5, well-conditioned recording can be realized by concentrating ink fluid ejection energy promptly into the area of the fluid path adjacent to the ejection orifice.

In the structure shown in FIG. 5, the front end part of the electric resistance element 5 near the ejection orifice 2 is not located in the region of the fluid path with its width being maintained to be constant or increasing.

In the above mentioned structure of the fluid path, as a full-grown bubble tends to move toward both walls of the fluid path in the backward side of the fluid path, which has a smaller width than above-mentioned maximum width, ink fluid in the forward side between the electric resistance element 5 and the ejection orifice can be promptly transported to the ejection orifice. In this embodiment, the growth of the bubble in the backward side can be relatively small, and thus ink fluid refilling performance can be maintained to be good.

Figure 6:
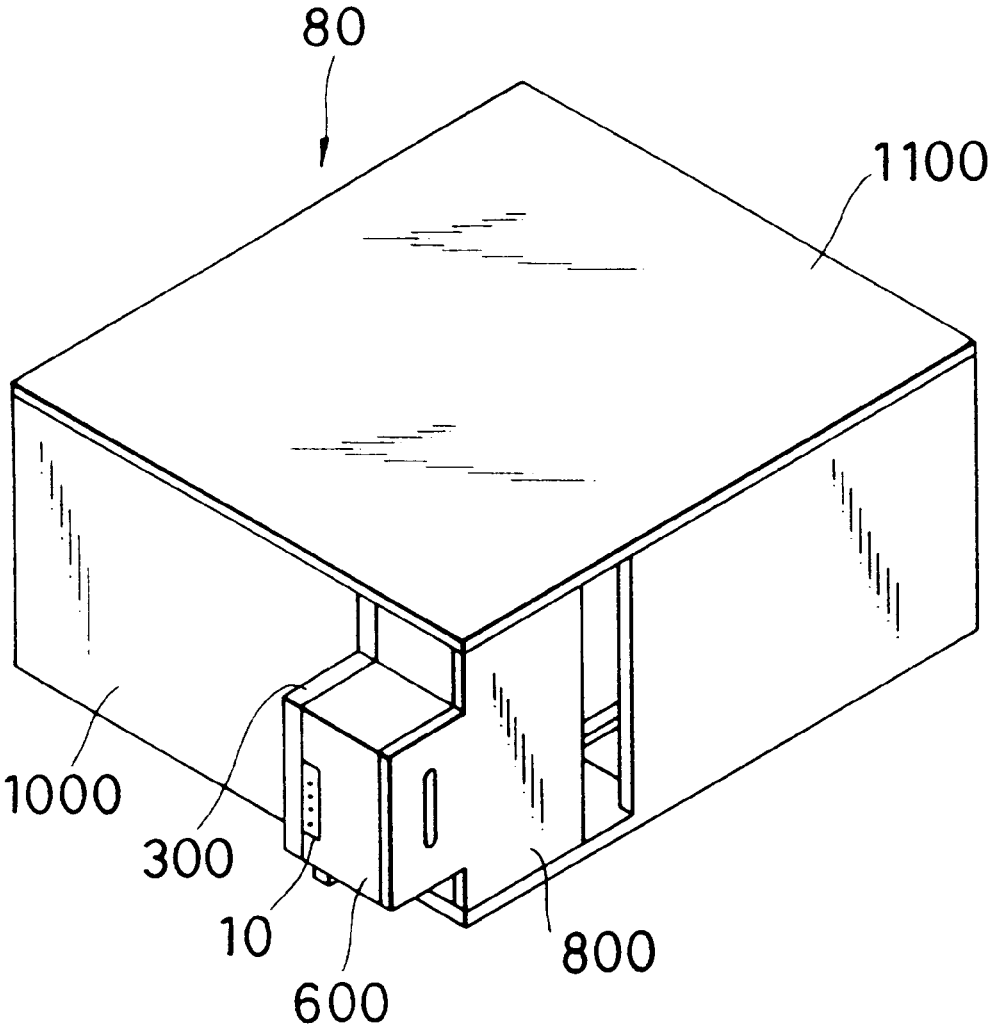
FIG. 6 is a perspective view of a head cartridge formed with a fluid ejection head of one embodiment of the present invention.

FIG. 6 is a fluid ejection recording head with its structure being described above and assembled to be a single unit including an ink tank which can be exchangeable. This recording head, which is conventional in appearance, is constructed in accordance with the foregoing description of this invention.

The recording head chip 10 shown in FIG. 6 is composed by connecting a top plate having concave parts (grooves) forming fluid paths and a common fluid reservoir described above, and a silicon substrate on which electric resistance elements for generating ink fluid ejection energy and electronic circuitry for supplying electric power to these elements are formed by thin film development technologies.

A component 600 in FIG. 6 is a sub ink tank placed to be adjacent to the recording head chip 10, and both the sub ink tank 600 and the recording head chip 10 are supported by covers 300 and 800. A component 1000 is a cartridge body and a component 1100 is a cover member of the cartridge body. An ink tank installed inside the cartridge body 1000 and used for supplying ink fluid into the sub ink tank 600. A recording head cartridge 80 can be formed by assembling the recording head chip 10 and the carriage body 1000 in an integral body.

Figure 7:
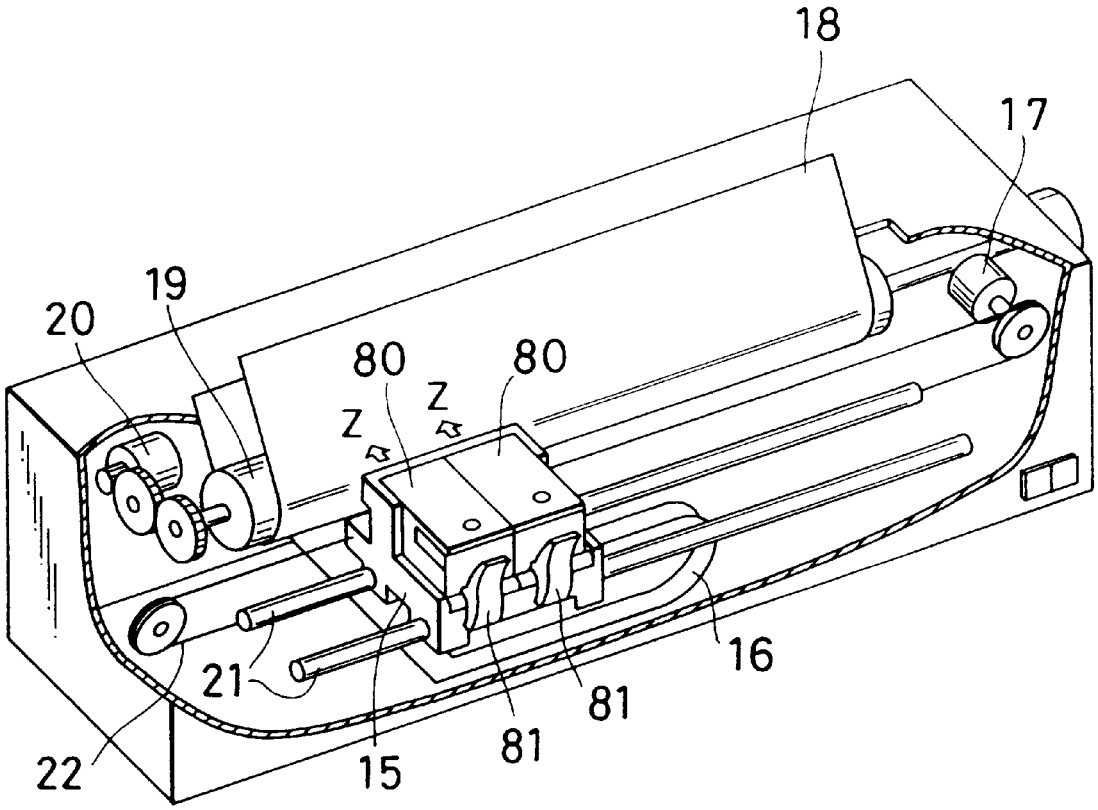
FIG. 7 is a perspective view of a fluid ejection recording apparatus for which the head cartridge shown in FIG. 6 can be used.

The recording head of the present invention can be installed in the cartridge 80 shown in FIG. 6 and also be used for forming a fluid ejection recording apparatus shown in FIG. 7. This recording apparatus, which is also conventional in appearance, includes the cartridge depicted in FIG. 6, and thus it too in constructed in accordance with the foregoing description of this invention.

In FIG. 7, the component 80 is a cartridge shown in FIG. 6, which is fixed on the carriage 15 by the pressing member 81 so that the carriage 15 and the cartridge 80 may be guided by the shaft 21 and moved in a to-and-fro motion along the longer side of the shaft 21. In fixing the cartridge 80 on the carriage 15, a protruding portion formed on the carriage 15 is locked in a hole formed on the cover 300. Electric connections to the cartridge 80 are provided by coupling a connector on the carriage to a connector pad of the circuitry board on the cartridge 80.

Ink fluid ejected from the recording head reaches a surface of the recording medium 18 supported by the platen 19 and forms an recorded image on the surface of the recording medium 18.

Ink fluid ejection signals responsive to recorded images are supplied from the data storage for storing data of recording images through a cable 16 and terminals connected to the cable 16. A cartridge 80 can be provided for each ink color and in FIG. 7 the number of the cartridges 80 is two.

In FIG. 7, a component 17 is a carriage motor for moving the carriage 15 along the shaft 21, a component 22 is a wire for transmitting a driving force of the carriage motor 17 to the carriage 51. A component 20 is a feed motor for driving the platen roller 19 and feeding the recording medium 18.

In this embodiment, the ejection orifice part of the embodiment is shown to be an end part of the fluid path with its width reduced gradually. As a modification of this embodiment, it is allowed that the cross-section of this end part of the fluid path forming the ejection orifice may be further reduced and that the thickness of the ejection orifice may be increased.

Fifth Embodiment

Figure 8:
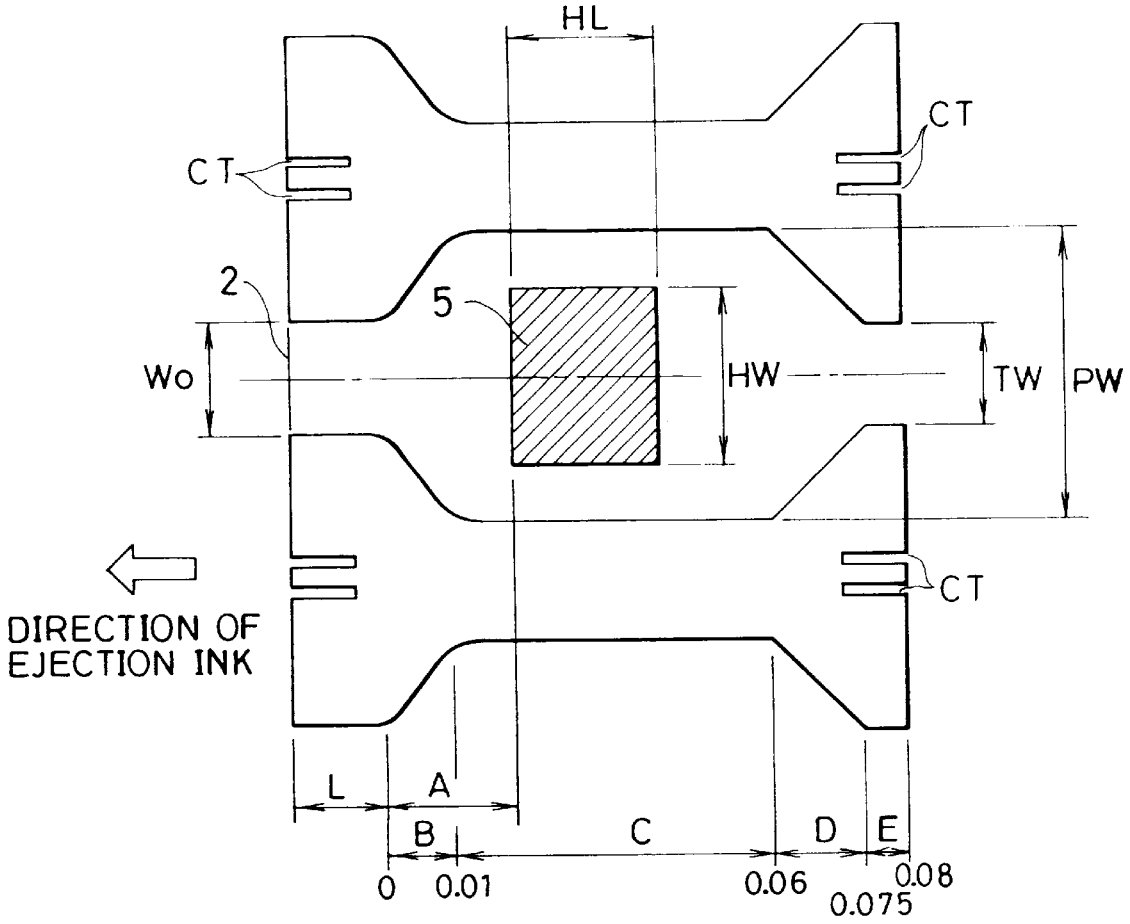
FIG. 8 is a plan view of a fluid path of a fluid ejection head of a fifth embodiment of the present invention.

FIG. 8 is a schematic plan view of a fluid path part of a recording head of the fifth embodiment of the present invention. The fluid ejection recording head has 128 election orifices and connecting fluid paths, all of which are assembled in a single body. The fluid paths are arranged with separation distance 63.5 $\mu$m. She fluid paths of the present invention may be preferable to form the ejection head with its fluid path separation distance being less than the above distance, 63.5 $\mu$m. The bottom and upper faces of the fluid paths are shaped in a flat plate.

The above mentioned ejection head is fabricated in the following process. A 1 $\mu$m thick $SiO_2$ layer is formed on a silicon wafer. Next, on the $SiO_2$ layer, $HfB_2$ and Al films are developed by a spattering process, and these films are shaped in a designated shape for electric resistance elements and electrodes. And next, $SiO_2$ and Ta films are formed on the $HfB_2$ and Al formed films by the spattering process and shaped by a photo-lithographic process. So far, in the above process, the heater board is completed. Next, a nega-type dry film is bonded on the heater board and exposed with a designated shaped mask in order to form separation walls of the fluid path. On the separation walls, a top plate made of glass materials is fixed. By cutting unnecessary parts from the board, ejection orifices and ejection heads are formed. So far, a major part of the ejection head is almost finished. Additionally, a supporting member, an ink supply system, and electronic elements are mounted to complete the ejection head.

In this embodiment, the electric circuitry the electric resistance elements is not shown in FIG. 8, but has three wiring cables are connected to a couple of electric resistance elements. In this embodiment, the width of the back end side of the fluid oath opposite to the ejection orifice is reduced as well as the ejection orifice. Owing to this structure, when the bubble is generated in ink fluid path on the thermal energy apply face by the electric resistance element, a counter flow of ink fluid from the fluid path back to the common fluid reservoir is restricted. As a result, unnecessary movement of the meniscus is prevented so that refilling actions may be performed promptly. In addition, this structure reduces unfavorable vibration of the meniscus after refilling actions.

Dimensions A, L, Wo, HL shown in FIG. 8 and Ph, the height of the ejection orifice measured from the electric resistance element, not shown in FIG. 8 are modified and some samples for fluid ejection recording heads are estimated. A is measured between a first end of the resistance toward the orifice and a first end of the first path part by the resistance. In measuring the performance of the ejection head, the driving voltage is 1.2 times as large as the lowest voltage with which fluid ejection operation is possible and the pulse width of the driving signal is 4 $\mu$sec.

Figure 9:
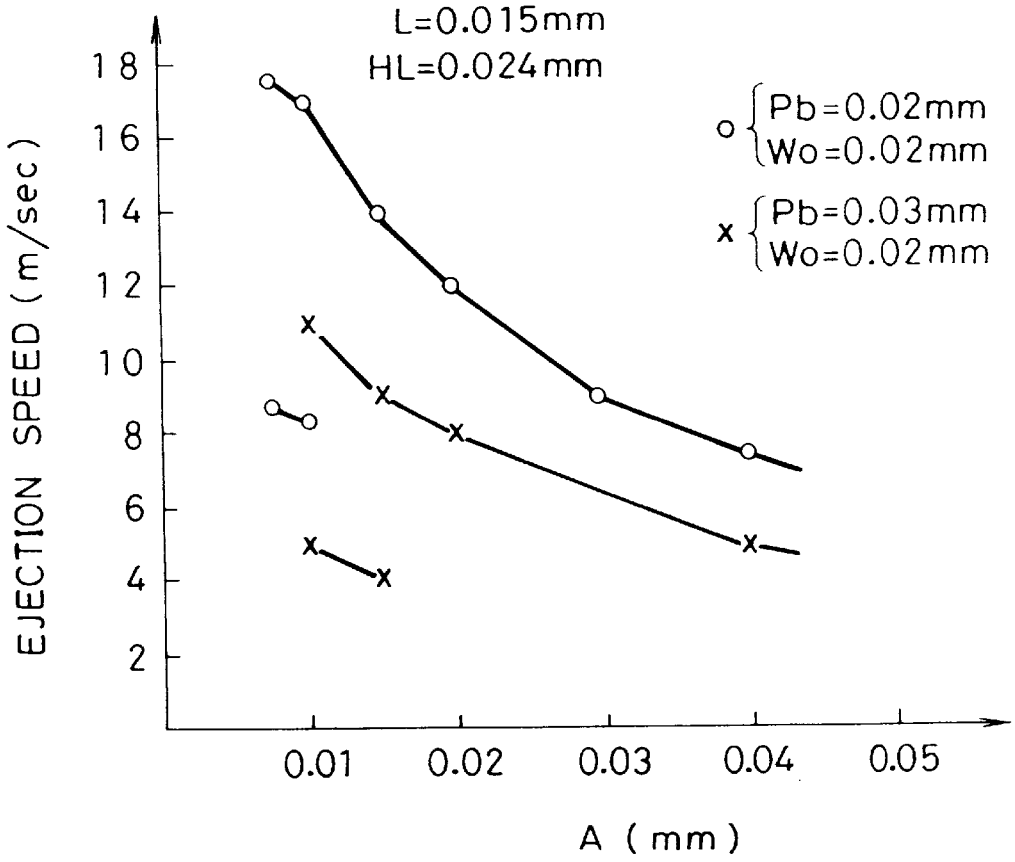
FIG. 9 is a diagram showing an effect of a fluid ejection head of the fifth embodiment of the present invention.

FIG. 9 shows the measurement result of the performance of samples of fluid ejection recording heads. The amount of ejected ink fluid depends on the ejection heads. In case that Ph is 0.02 mm and A is less than or equal to 0.01 mm or that Ph is 0.03 mm and A is less than or equal to 0.015 mm, the fluid election speed may be unstably transitive between two values. In this example, if Ph is 0.02 mm, A is greater than or equal to 0.01 mm and less than about 0.035 mm, the ejection speed can be stabilized to be a higher value. If Ph is 0.03 mm, A may be taken to be greater than or equal to 0.015 mm.

The driving frequency is 16 kHz when Ph is 0.02 and A is 0.015 mm. The driving frequency is less than or equal to 10 kHz when A is 0.04 mm. In each case, the amount of ejected ink fluid is 11 pl and 6 pl, respectively.

In case that Wo is 0.016 mm or 0.022 mm and Ph is 0.02 mm, the range of A giving a stable ejection speed is the same as that in the above mentioned case. However, when Wo is 0.026 mm and A is even 0.02 mm, the ejection speed is unstable.

In case that Ph is 0.02 mm and A is 0.01 mm and even that L is 0.02 mm, the ejection speed is unstably transitive between two values. In case that A is 0.015 mm and L is 0.01 mm, the ejection speed is stably 16 m/sec. HL, the length of the electric resistance element measured in the direction along which ink fluid is ejected can be between 0.01 mm and 0.028 mm for establishing a stable ejection speed.

Sixth Embodiment

Figure 10A:
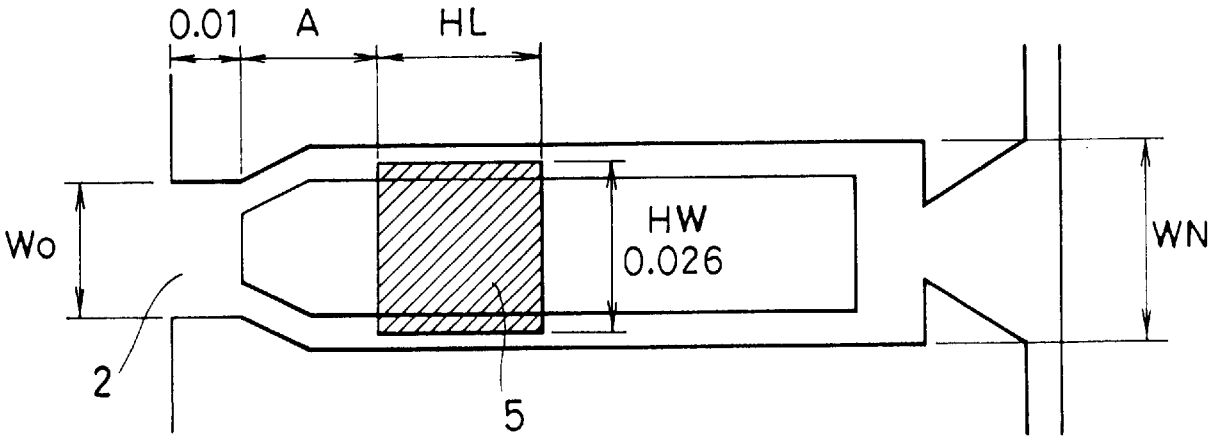
FIGS. 10A and 10B are a plan view respectively and a cross-sectional view of a fluid path of a fluid ejection head of a sixth embodiment of the present invention.
Figure 10B:
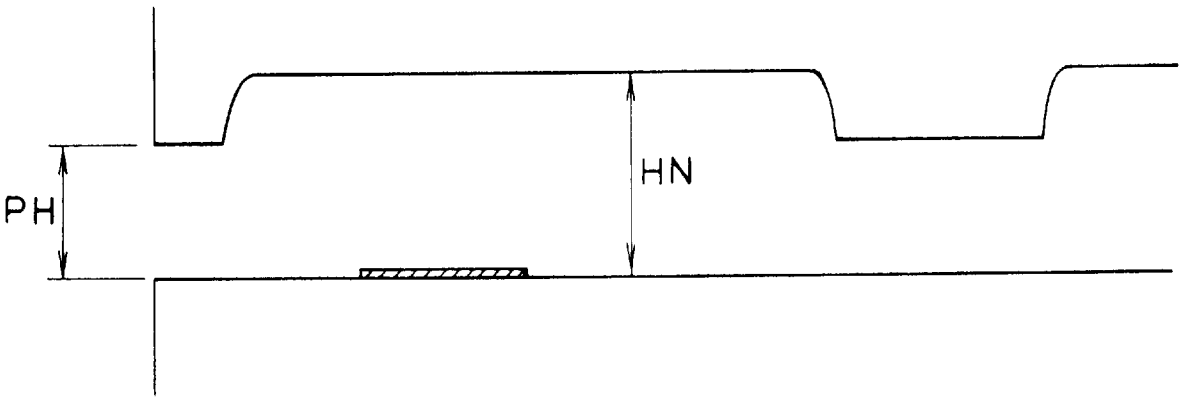

FIGS. 10A and 10B are a plan view and a cross-sectional view of a fluid path of the ejection head of the sixth embodiment of the present invention. In FIGS. 10A and 10B, a single fluid path is shown while in an actual fluid ejection head, 256 fluid paths are formed in a single body. The distance between adjacent fluid paths is 53 $\mu$m in order to attain a recording density of 480 dots per inch.

The fluid ejection head of the sixth embodiment is fabricated by the following process. The process for forming a heater board is the same as that in the fifth embodiment. After forming a heater board, nega-type resist is coated on the heater board and exposed with a mask shaped in a lower part of the fluid path. Next, nega-type resist is coated again and exposed with a mask shaped in a upper part of the fluid path. After an etching process of the exposed heater board, a nega-resist layer remains on the heater board to be shaped in a designated shape of the fluid path. After filling the heater board with a photo-hardening resin and covering up the heater board with an upper plate made of glass materials, ultraviolet rays are exposed. By cutting unnecessary parts from the board, ejection orifices and ejection heads are formed. A nega-type resist layer is removed with solvent. So far, a major part of the ejection head is almost finished Additionally, a supporting member, an ink supply system, and electronic elements are mounted to complete the ejection head.

In the recording head fabricated in the above process, the cross-section of the fluid path is changed not only in the width direction as shown in FIG. 10A but also in the height direction because the resist layer is exposed twice in the fabrication process.

TABLE 2

| | | Design 1 | Design 2 | Design 3 | Design 4 |
|---|---|---|---|---|---|
| Dimension | WO | 0.02 mm | 0.018 mm | 0.02 mm | 0.02 mm |
| | H | 0.02 mm | 0.018 mm | 0.02 mm | 0.02 mm |
| | WN | 0.03 mm | 0.03 mm | 0.03 mm | 0.03 mm |
| | HN | 0.03 mm | 0.025 mm | 0.03 mm | 0.035 mm |
| | A | 0.02 mm | 0.01 mm | 0.06 mm | 0.008 mm |
| | WH | 0.024 mm | 0.022 mm | 0.024 mm | 0.024 mm |
| Result | Ejection speed | 13.5 m/sec. | 14.5 m/sec. | 5 m/sec. | not measured |
| | Amount of Ejected ink | 13 pl | 8 pl | 6 Pl | |
| | Available driving frequency | 12 kHz | 14 kHz | 4 kHz | |
| Appraisement | | ○ | ○ | X | X |

Table 2 shows the performance of some samples of ejection heads with its component sizes varied as shown in the FIGS. 10A and 10B. The driving conditions for the ejection head is similar to those in fifth embodiment. As found in Table 2, both of Design 1 and Design 2 give a good performance of the ejection head. In Design 3, A is longer than that in Design 1, and hence, the ejection speed and the available driving frequency are far less than those in Design 1. In addition, in Design 3, A is taken to be shorter, and therefore, the ejection action is not stably maintained and the ejection speed cannot be measured in a stable experimental condition.

Seventh Embodiment

Figure 11:
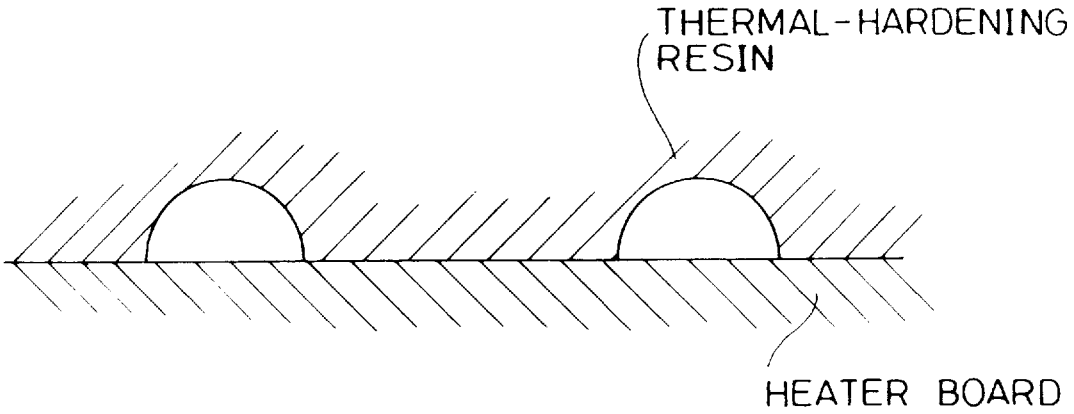
FIG. 11 is a front view of an example modification of a fluid.ejection head of a seventh embodiment of the present invention.

A heater board is fabricated in the same manner as that in the fifth embodiment. A posi-type resist layer is formed on the heater board and shaped in a designated shaped fluid path shown in FIG. 8 by exposure and chemical processing. The heater board with a shaped posi-resist layer is next filled with thermal-hardening resin materials and molded by transfer molding processing. By cutting unnecessary parts from the board, ejection orifices and fluid ejection heads are formed. The shaped posi-type resist layer is removed with solvent. In this fabrication method, in case that the heat resistance of posi-type resist materials is relatively low and the process temperature when transfer molding processing is high, the posi-resist layer may be deformed in the molding process and in some cases, the ejection orifice may be shaped almost in a semicircle as shown in FIG. 11. In the seventh embodiment, the fluid ejection head is fabricated as described above. The shape of the fluid path is similar to that in FIG. 8, and the height of the fluid path at the electric resistance element is 0.022 mm. The ejection orifice is shaped almost as a semicircle where the bottom length of the ejection orifice is 0.02 mm, the maximum height of the ejection orifice is 0.01 mm. When L is 0.01 mm, HL is 0.020 mm, and A is 0.08 mm, the ejection speed is measured to be stably 12 m/sec.

Eighth and Ninth Embodiments

In the following, the structure of an fluid ejection head of eighth and ninth embodiments of the present invention will be described.

In case that the cross-section area of the fluid path varies in the neighboring area to the ejection orifice, for example, the fluid path is tapered, the cross-section area of the ejection orifice varies due to the displacement of the cutting position at the heater board. This deviation of the cross-section area of the ejection orifice gives an unfavorable effect upon the deviation of the amount of the ejected ink fluid. So far, the deviation of the amount of the ejected ink fluid due to the unfavorable displacement of the ejection orifice gives rise to a non-uniform ink fluid distribution on a recorded image. And also, the ejection direction of ink fluid may not be regulated stably to be a uniform direction. In order to solve these problems partially, it is supposed to be valid that the cross-section area of a part of the fluid path adjacent to the ejection orifice is made to be constant. This solution is not sufficient enough to solve the above problems. Even if the unfavorable displacement of the cutting position for forming the ejection orifice is fortunately within the part of the fluid path where the cross-section area is defined to be constant, due to the deviation in the distance between the ejection orifice and the electric resistance element, the deviation of the flow impedance occurs in different fluid paths which leads to the deviation of the ejected amount of ink fluid and to the non-uniform ink fluid distribution on a recorded image.

The above problems are generic to a recording method where ink fluid is ejected by pressure waves given by the development of a bubble generated by thermal energy through an electric resistance element. In another kind of recording method, for example, using piezoelectric elements for ejecting ink fluid by pressure waves given by the deformation of the element, the ejection volume of ink fluid is determined definitely by the manner in changing the driving voltage of the piezoelectric element just after ink fluid comes out of the ejection orifice, and the fluid path impedance between the piezoelectric element and the ejection orifice does not affect the ejection volume. In using piezoelectric elements, in order to reduce the ejection volume of ink fluid by controlling the separating operation of liquid drops at the ejection orifice, it is a prospective way to restore the deformation of the piezoelectric element in a earlier time.

On the other hand, using a bubble for ejecting ink fluid, pressure waves generated by the bubble cannot be controllable because they are determined by combinations of stored energy in ink fluid, temperature distribution in ink fluid and dynamic behaviors of ink fluid in the fluid path. The ejection volume is mainly dependent on the viscosity resistance of ink fluid between the electric resistance element and the ejection orifice. So far, the dimensional deviation of the distance between the electric resistance element and the ejection orifice is principally reflected directly on the deviation of the ejection volume of ink fluid.

In this invention, used is theoretical and experimental background reasoning that this deviation or the ejection volume of ink fluid can be reduced within an allowable limitation.

Assume that a tube with an open entrance shaped in a horn is connected to a large reservoir, and the entrance length L in the horn-shaped tube is given by the following formula, $$L=0.065Re\times d \text{ (in a laminar flow)}$$

or $$L=(25\sim40)\times d \text{ (in a turbulent flow)},$$

where d is the diameter of the tube.

The entrance length L defined in the above formula can be interpreted in the following manner. In the region of the tube adjacent to the entrance of the tube where the length from the entrance is far less than L, the flow in the tube is almost identical at any point on the cross-section of the tube. In this region, the pressure loss due to the reduction of the momentum of ink fluid flow in the entrance of the tube is dominant to the viscosity resistance against the tube wall. So far, in this region near the entrance of the rube, the fluid path impedance can be estimated to be constant. Beyond this region far from the entrance of the tube, the flow rate distribution on the cross-section of the tube is developed gradually, and the fluid path impedance increases as the flow goes inside the tube due to the viscosity resistance against the tube wall, but the linearity between the fluid path impedance and the displacement from the entrance of the tube may not be completely established. After the flow goes beyond the entrance length L from the entrance of the tube, the flow rate distribution is fully developed and maintained to be a stationary state, and hence, the fluid path impedance is proportional to the displacement along the fluid path.

In case of ejecting fluid by using pressure waves generated by the bubble, the width (or height) of the ejection orifice is assumed to be less than 50 $\mu$m, the fluid density $\rho$ is supposed to be 1 g/cm$^3$, the viscosity $\eta$ of ink fluid is greater than 0.001 Pa·sec, and the flow velocity v is less than 20 m/sec. With these parameters, Re, which is defined as $Re=\rho dv/\eta$, is less than 2000. This means that the flow in the fluid path is a laminar flow in case of ejecting fluid by using pressure waves generate by the bubble. In addition, the length of the region of the tube adjacent to the entrance of the tube where the fluid path impedance is almost constant is supposed to be proportional to Re·d according to a similarity law in fluid dynamics. If the length of the region where the cross-section area of the fluid path adjacent to ejection orifice is constant is changed within the entrance length L, the fluid path impedance between the electric resistance element and the ejection orifice is about constant, and hence the ejection volume of ink fluid is almost constant. In this invention, newly found is that, even when the length is of the region where the cross-section area of the fluid path is constant is changed, the ejection volume of fluid is not changed if the length ls is less than or equal to 0.015 Re·d.

And furthermore, it is also found that the length ls is preferably greater than or equal to d/4 because the cross-section area of the fluid path near the ejection orifice is required to be within a designated amount even if the displacement of the above-mentioned cutting position for forming the ejection orifice on the heater board and because the stability in ejection direction of ink fluid.

It should be noted that the ejection speed of ink fluid is not constant even in the present invention and dependent upon the length is defined above. However, this makes no practical disadvantage because the effect of the ejection speed upon the recording performance can be negligible. The ejection speed of ink fluid is determined by energy applied to ink fluid near the ejection orifice at the moment of generating the bubble, and in case that the length ls is large, the amount of ink fluid to be given enough energy to reach a designated speed is larger and hence, the acceleration is smaller and the ejection speed is reduced.

Eighth Embodiment

Figure 12:
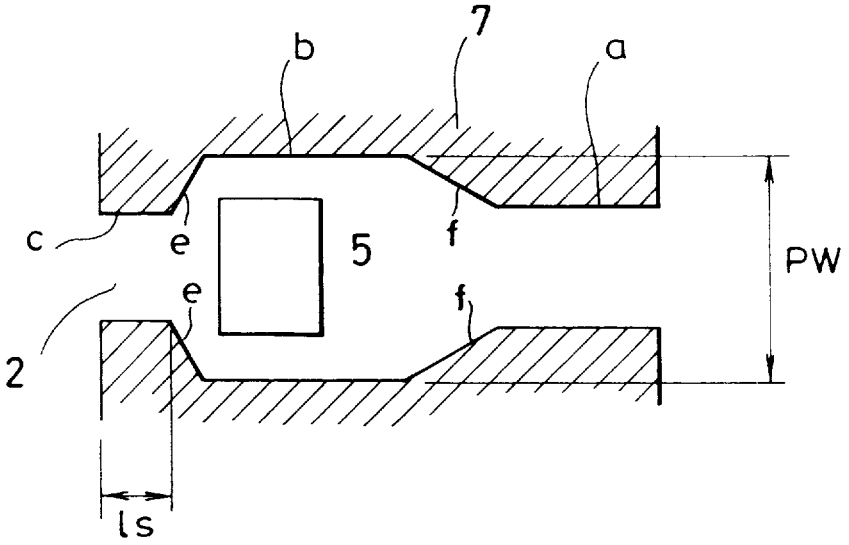
FIG. 12 is a plan view of a fluid path of a fluid ejection head of a eighth embodiment of the present invention.

FIG. 12 is a plan view showing a fluid path of a fluid ejection head of the eighth embodiment of the present invention. The head used in this embodiment is fabricated by the following process; electric resistance elements 5 and electrodes not shown in FIG. 12 are formed on a silicon wafer by spattering a 1 μm thick $SiO_2$ protective layer is formed on it, and after a separation wall 7 is formed with photosensitive resin materials, a top plate made of glass materials not shown in FIG. 12 is bonded, and finally each head is obtained by cutting the wafer into pieces so that the cutting plane may be parallel to an ejection orifice disposed face. A component 2 is an ejection orifice, a component c is a part of the fluid path adjacent to the ejection orifice where the cross-section area is constant and the length is of this part c is 15 μm. The ejection orifice is formed so that the width is 20 μm and the height is 20 μm. The diameter of the fluid path d is equivalent to the width of the ejection orifice, 20 μm. The size of the electric resistance element is 25 μm×30 μm, and the distance between the front end of the electric resistance element 5 and the ejection orifice 2 is 35 μm. PW, the width of the fluid path where the electric resistance element 5 is formed, is 45 μm. Therefore, the cross-section area of the fluid path where the electric resistance element 5 is formed is 2.25 times as large as that of the fluid path adjacent to the ejection orifice. The cross-section area of the fluid path around the electric resistance element is constantly 45 μm×20 μm. The length of this fluid path is 80 μm. The size of the cross-section area of the fluid path closer to the common fluid reservoir is reduced to be 30 μm×20 μm. The overall length of the fluid path is 170 μm.

In this embodiment, ink fluid is mainly composed of 80% water and 20% diethylenglycol and its viscosity η is 0.0024 pa·sec, its density ρ is 1.02 g/cm$^3$, and its surface tension is 42 dyn/cm. In driving the ejection head experimentally with ink fluid as described above, observed is that the ejection speed v is 10.7 m/sec and that the ejection volume is about 8×10−9 cm$^3$. In this experiment, $ls/(\rho v d^2/\eta)$ is 0.001.

Figure 13A:
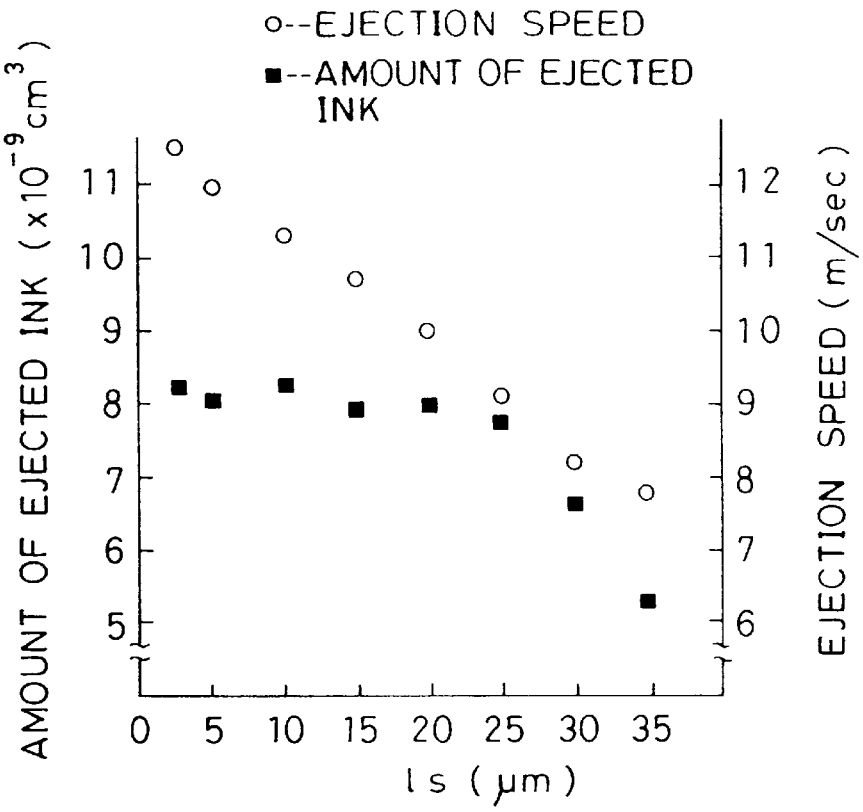
FIGS. 13A and 13B are diagrams explaining an effect of a fluid election head of the eighth embodiment of the present invention.
Figure 13B:
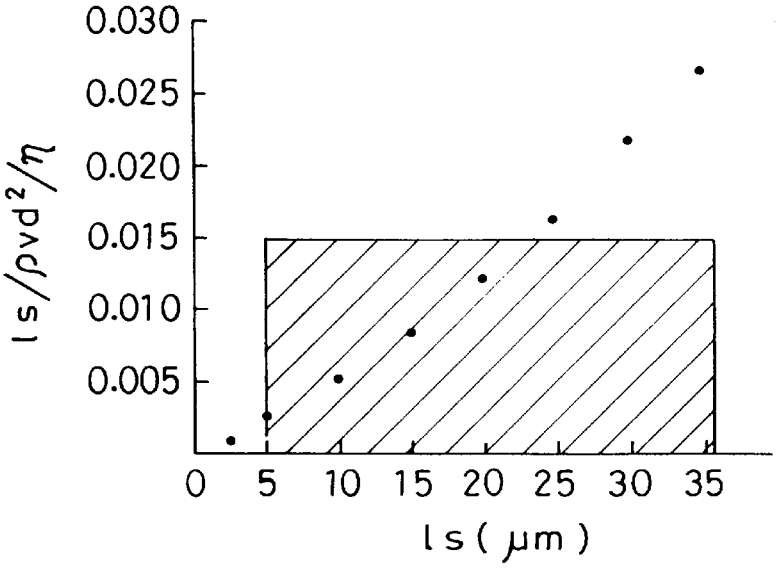

In FIG. 13A, the ejection speed v and the ejection volume $V_d$ are shown with respect to the entrance length ls, 2.5 μm, 5 μm, 10 μm, 20 μm, 25 μm, 30 μm, 35 μm, and 40 μm, and in FIG. 13B, $ls/(\rho v d^2/\eta)$ is shown with respect to the entrance length ls. The ejection speed gradually reduces as the entrance length Is increases while the ejection volume is almost constant with is being less than or equal to 25 μm. In case of is being equal to 2.5 μm which is less than d/4, the ejection direction is not stably determined. In case of is being greater than or equal to 5 μm, the ejection direction is stably determined.

The hatched region in FIG. 13B corresponds to an operational region when using a specific ink fluid and a specific recording head, and when the entrance length ls is within this region, the ejection direction is stable and the ejection volume is maintained to be constant.

As described above, in cutting the heater board for obtaining a recording head, the displacement of the cutting position should be allowed to be between −5 μm and 5 μm. In this practical condition, the entrance length ls is deviated by ±5 μm around 15 μm, and in this embodiment, the ejection direction and the ejection volume will be appreciated not to be affected by this deviation.

Ninth Embodiment

Figure 14A:
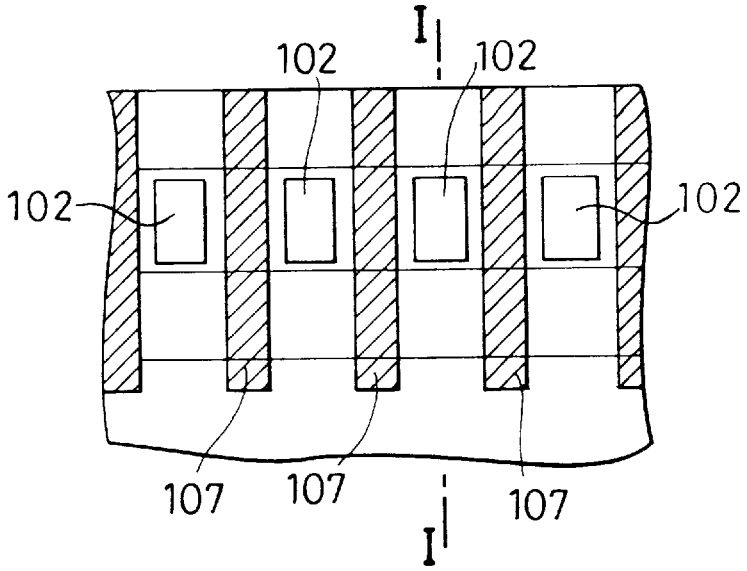
FIGS. 14A and 14B are a plan view and a cross-sectional view taken along line I—I in FIG. 14A of a fluid path of a fluid ejection head of a ninth embodiment of the present invention.
Figure 14B:
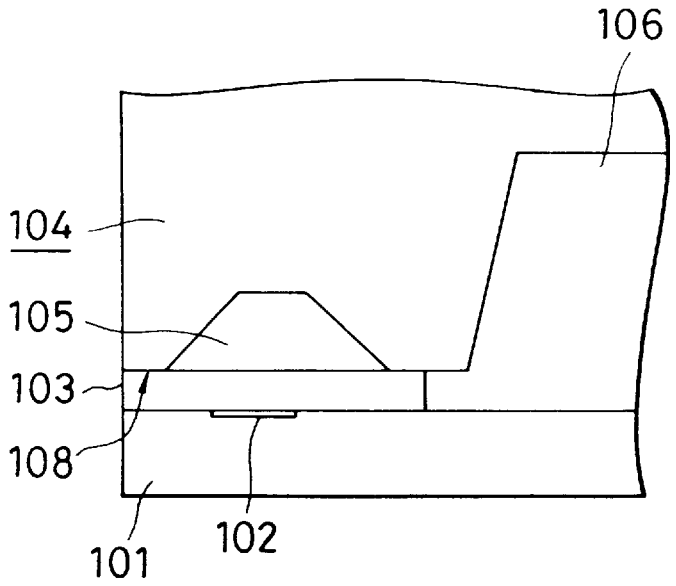

FIGS. 14A and 14B are a plan view of an ejection head of the ninth embodiment of the present invention and a cross-sectional view taken along line I—I in FIG. 14A. In this embodiment, in case that the width of the fluid path around the electric resistance element cannot be expanded due to a layout restriction such as accommodation of a larger number of fluid paths, for example, 24 fluid paths per 1 mm, by changing the height of the fluid path, the cross-section area of the fluid path around the electric resistance the fluid path can be taken to be greater than that of the ejection orifice.

In FIG. 14B, a component 104 is a silicon substrate, a component 102 is an electric resistance element formed on the silicon substrate 104 in the same manner as that in the eighth embodiment, a component 103 is an ejection orifice and a component 104 is a top plate formed by molding resin materials, where a component 105 is an extended recess formed above the electric resistance element 102 and a component 106 is also an extended recess corresponding the common fluid reservoir. A component 107 is a separation wall formed in the same manner as in the eighth embodiment. In fabricating an ejection head, after the top plate 104 is bonded on the separation wall 107, each ejection head is obtained by cutting the substrate in the same way as in the eighth embodiment. Therefore, the entrance length is of the part 108 where the cross-section area of the fluid path adjacent to ejection orifice is maintained to be constant is deviated by 10 μm around its nominal value 25 μm, and the width of the ejection orifice is 27 μm and the height of the ejection orifice is 25 μm, and the width and the height of the fluid path around the electric resistance element is 27 μm and 45 μm respectively, the width of the separation wall is about 15 μm and its length is 320 μm. The size of the electric resistance element is 18 μm×60 μm and the distance between the front end of the element and the ejection orifice is 60 μm±10 μm. The components of ink fluid used are the same as those in the eighth embodiment. In this embodiment, the diameter of the fluid path d is supposed to be the height of the ejection orifice, 25 μm.

Figure 15A:
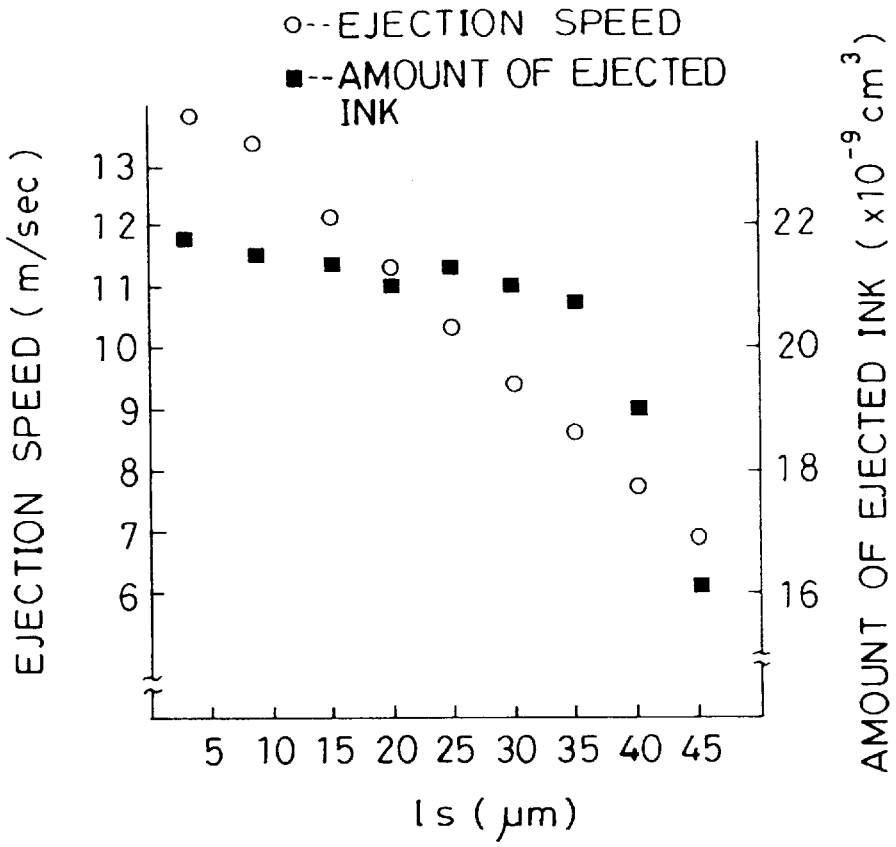
FIGS. 15A and 15B are diagrams explaining an effect of a fluid ejection head of the ninth embodiment of the present invention.
Figure 15B:
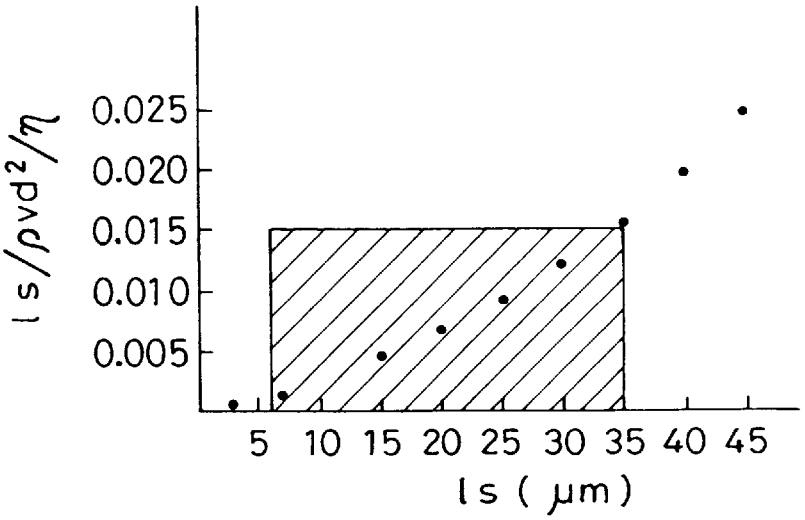

FIG. 15A and 15B show the ejection speed, the ejection volume and $ls/(\rho v d^2/\eta)$ with respect to the entrance length ls being changed between 2 μm and 45 μm. In this embodiment, ls is taken to be one of discrete values, 7, 15, 20, 25, 30 and 35 μm. In case of is being 3 μm, the ejection direction is unstable.

In case that ls is between 7 μm and 35 μm, the ejection volume is maintained stably to be $(21\pm0.5)\times10^{-9}$ cm$^3$. In case of is being greater than 35 μm, the ejection volume decreases as is increases. Thus, the range between 7 μm and 35 μm for is gives a stable ejection speed and volume. In this condition, $ls/(\rho v d^2/\eta)$ is less than 0.015 and ls is greater than d/4, which corresponds to the hatched region in FIG. 15B.

As described above, this invention is valid not only for the case that the width of the fluid path increases from the ejection orifice toward the backward side but also for the case that the height of the fluid path increases in the same direction. Additionally, this invention may be valid for the case that both the width and the height of the fluid path increases from the ejection orifice toward the backward side.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A fluid ejection head comprising:

means for defining a plurality of election orifices;

means for defining a plurality of fluid paths each of which corresponds to one of the election orifices and is connected to the respective corresponding election orifice;

means for defining a common fluid reservoir for storing fluid to be supplied to the fluid paths, the common fluid reservoir connected to the fluid paths; and a plurality of electric resistance elements, each of which is disposed in one of the fluid paths and is shaped in a plane for defining a thermal applicating face for forming a bubble by imparting thermal energy to fluid in the fluid path and inducing film boiling in the fluid, wherein each of the plurality of fluid paths further comprises:

a first path part having a cross-sectional area equivalent to a cross-sectional area of the corresponding ejection orifice and being positioned adjacent to the ejection orifice;

a second path part continuously adjacent to the first path part and having a cross-sectional area increasing continuously from the cross-sectional area of the first path part toward the common fluid reservoir;

a third path part adjacent to the second path part, having a constant cross-sectional area and including at least a portion of said electric resistance element; and a fourth path part adjacent to the third path part, including a part having a cross-sectional area decreasing from the cross-sectional area of the third path part toward the common fluid reservoir, and connecting to the common fluid reservoir, a center of said electric resistance element being included in said third path part or in said fourth path part, and wherein a distance A between a first end of said electric resistance element toward the ejection orifice and a first end of the first path part toward said electric resistance element is greater than half of a height Ph of the ejection orifice, the height Ph being projected on a side of said electric resistance element, and a distance L+A between the ejection orifice and the first end of said electric resistance element is less than a sum of half of the height Ph and a length L of the first path part, and the third path part at least has a cross-sectional area two times as large as the cross-sectional area of the ejection orifice.

2. A fluid ejection head as claimed in claim 1, wherein an area of said electric resistance is at least half of a cross-sectional area of the ejection orifice and not more than three times the cross-sectional area of the ejection orifice.

3. A fluid ejection head as claimed in claim 1, wherein a length of said electric resistance element measured in a direction in which fluid flows is less than or equal to a width of said electric resistance element.

4. A fluid ejection head as claimed in claim 1, wherein the length L of the first path part is greater than or equal to d/4 and less than or equal to $0.015\ pvd^2/\eta$, where p is a density of the fluid, $\eta$ is a viscosity of the fluid, v is an ejection speed of the fluid, and d is a width or a height of the ejection orifice.

5. A fluid ejection head comprising:

means for defining a plurality of ejection orifices;

means for defining a plurality of fluid paths each of which corresponds to one of the ejection orifices and is connected to the respective corresponding ejection orifice;

means for defining a common fluid reservoir for storing fluid to be supplied to the fluid paths, the common fluid reservoir connected to the fluid paths; and a plurality of electric resistance elements, each of which is disposed in one of the fluid paths and is shaped in a plane for defining a thermal applicating face for forming a bubble by imparting thermal energy to fluid in the fluid path and inducing film boiling in the fluid, wherein each of the plurality of fluid paths further comprises:

a first path part having a cross-sectional area equivalent to a cross-sectional area of the corresponding election orifice and being positioned adjacent to the ejection orifice;

a second path part continuously adjacent to the first path part and having a cross-sectional area increasing continuously from the cross-sectional area of the first path part toward the common fluid reservoir;

a third path part adjacent to the second path part, having a constant cross-sectional area and including at least a portion of said electric resistance element; and a fourth path part adjacent to the third path part, including a part having a cross-sectional area decreasing from the cross-sectional area of the third path part toward the common fluid reservoir, and connecting to the common fluid reservoir, a center of said electric resistance element being included in said third path part or in said fourth path part, and wherein the third path part has a cross-sectional area at least two times larger than the cross-sectional area of the ejection orifice; and a length L of the first path part is greater than or equal to d/4 and less than or equal to $0.015\ pvd^2/\eta$, where p is a density of the fluid, $\eta$ is a viscosity of the fluid, v is an ejection speed of the fluid, and d is a width or a height of the ejection orifice.

6. A recording apparatus comprising:

a fluid injection head, including:

means for defining a plurality of ejection orifices;

means for defining a plurality of fluid paths, each of which corresponds to one of the ejection orifices and is connected to the respective corresponding ejection orifice;

means for defining a common fluid reservoir for storing fluid to be supplied to the fluid paths, the common fluid reservoir connected to the fluid paths; and a plurality of electric resistance elements, each of which is disposed in one of the fluid paths and is shaped in a plane for defining a thermal applicating face for forming a bubble by imparting thermal energy to fluid in the fluid path and inducing film boiling in the fluid, wherein each of the plurality of fluid paths further comprises:

a first path part having a cross-sectional area equivalent to a cross-sectional area of the corresponding ejection orifice and being positioned adjacent to the ejection orifice;

a second path part continuously adjacent to the first path part and having a cross-sectional area increasing continuously from the cross-sectional area of the first path part toward the common fluid reservoir;

a third path part adjacent to the second path part, having a constant cross-sectional area and including at least a portion of said electric resistance element containing a center thereof and extending toward the orifice; and a fourth path part adjacent to the third path part, including a part having a cross-sectional area decreasing from the cross-sectional area of the third path part toward the common fluid reservoir, and connecting to the common fluid reservoir, wherein a distance A between a first end of said electric resistance element toward the ejection orifice and a first end of the first path part toward said electric resistance element is greater than half of a height Ph of the ejection orifice, the height Ph being projected on a side of said electric resistance element, and a distance L+A between the ejection orifice and the first end of said electric resistance element is less than a sum of half of the height Ph and a length L of the first path part, and the third path part at least has a cross-sectional area two times as large as the cross-sectional area of the ejection orifice;

fluid supply means for supplying fluid to the common fluid reservoir;

driving means for inducing film boiling in the fluid by supplying an electric signal to said electric resistance element in response to a recording signal for driving said fluid ejection head; and feeding means for feeding a recording material to a position facing said fluid ejection head.

7. A recording apparatus comprising:

a fluid injection head, including:

means for defining a plurality of ejection orifices;

means for defining a plurality of fluid paths, each of which corresponds to one of the ejection orifices and is connected to the respective corresponding ejection orifice;

means for defining a common fluid reservoir for storing fluid to be supplied to the fluid paths, the common fluid reservoir connected to the fluid paths; and a plurality of electric resistance elements, each of which is disposed in one of the fluid paths and is shaped in a plane for defining a thermal applicating face for forming a bubble by imparting thermal energy to fluid in the fluid path and inducing film boiling in the fluid, wherein each of the plurality of fluid paths further comprises:

a first path part having a cross-sectional area equivalent to a cross-sectional area of the corresponding ejection orifice and being positioned adjacent to the ejection orifice;

a second path part continuously adjacent to the first path part and having a cross-sectional area increasing continuously from the cross-sectional area of the first path part toward the common fluid reservoir;

a third path part adjacent to the second path part, having a constant cross-sectional area and including at least a portion of said electric resistance element containing a center thereof and extending toward said orifice; and a fourth path part adjacent to the third path part, including a part having a cross-sectional area decreasing from the cross-sectional area of the third path part toward the common fluid reservoir, and connecting to the common fluid reservoir, wherein the third path part has a cross-sectional area at least area two times larger than the cross-sectional area of the ejection orifice; and a length L of the first path part is greater than or equal to d/4 and less than or equal to 0.015 $pvd^2/\eta$, where p is a density of the fluid, $\eta$ is a viscosity of the fluid, v is an ejection speed of the fluid, and d is a width or a height of the ejection orifice;

fluid supply means for supplying fluid to the common fluid reservoir;

driving means for inducing film boiling in the fluid by supplying an electric signal to said electric resistance element in response to a recording signal for driving said fluid ejection head; and feeding means for feeding a recording material to a position facing said fluid ejection head.

8. An ink jet recording head comprising:

means for defining at least one fluid path leading to an ejection orifice;

a heater having a face within the fluid path, wherein a bubble is generated by supplying electric power to said heater, and ink is ejected in a direction substantially parallel to said face of said heater, said fluid path further comprising:

a first part having a constant cross-sectional area located adjacent to the ejection orifice;

a second part located behind the first part and containing said heater, the cross-sectional area of the second part increasing by twice as large as the cross-sectional area of the ejection orifice, with a length A between an end of the first part and a top end of said heater being greater than or equal to half of a height Ph of the ejection orifice; and a shortest gap between the ejection orifice and said heater being less than or equal to a sum of half of the height Ph of the ejection orifice and a length of the first part.

9. An ink jet recording head as claimed in claim 8, wherein an area of said heater is greater than or equal to half of the cross-sectional area of the ejection orifice and less than or equal to three times the cross-sectional area of the ejection orifice.

10. An ink jet record head comprising:

means for defining at least one fluid path leading to an ejection orifice;

a heater having a face within a fluid path;

wherein a bubble is generated by supplying electric power to said heater, and ink is ejected in a direction substantially parallel to said face of said heater;

said fluid path further comprising:

a first path part having a constant cross-sectional area located adjacent to the ejection orifice, a length of the first path part is greater than or equal to d/4 and less than or equal to 0.0015 $pvd^2/\eta$, where p is a density of the fluid, $\eta$ is a viscosity of the fluid, v is an ejection speed of the fluid, and d is a width or a height of the ejection orifice; and a second path part located at an opposing side of the first path part from the ejection orifice, and having a cross-section which increases by twice as large as the cross-sectional area of the ejection orifice.

* * * * *

UNITED STATES PATENT AND TRADEMARK OFFICE

CERTIFICATE OF CORRECTION

PATENT NO. : 5,988,798

DATED : November 23, 1999

INVENTOR(S) : SHIN'ICHI HIRASAWA

It is certified that error appears in the above-identified patent and that said Letters Patent is hereby corrected as shown below:

ON THE TITLE PAGE [56] References Cited:

FOREIGN PATENT DOCUMENTS,
"187356" should read --1-87356 --.
1195050" should read --1-195050--.

ON THE TITLE PAGE AT [57] ABSTRACT:

Line 6, "orifice" should read --orifice,--.

COLUMN 1:

Line 15, "and is purposes" should read --purposes, and is--;
Line 35, "the" should be deleted; and
Line 40, "paths" should read --path--.

COLUMN 2:

Line 6, "case," should read --each case,--;
Line 7, "forth" should read --forth and--;
Line 43, "the" should read --a--; and
Line 66, "moved" should read --be moved--.

UNITED STATES PATENT AND TRADEMARK OFFICE

CERTIFICATE OF CORRECTION

PATENT NO. : 5,988,798

DATED : November 23, 1999

INVENTOR(S) : SHIN'ICHI HIRASAWA

It is certified that error appears in the above-identified patent and that said Letters Patent is hereby corrected as shown below:

COLUMN 3:

Line 31, "contradicting," should read --contradicting, objectives practically,--.

COLUMN 4:

Line 40, "once" should read --one--.

COLUMN 5:

Line 57, "with," should read --pieces, with--.

COLUMN 6:

Line 11, "line a-'a'" should read --line a-a'--;
Line 12, "line b-'b'" should read --line b-b'--;
Line 29, "view respectively" should read --view, respectively,--;
Line 33, "fluid.ejection" should read --fluid ejection--;
Line 37, "a" should read --an--;
Line 39, "election" should read --ejection--;
Line 63, "elements" should read --element--; and
Line 65, "orifices" should read --orifice--.

UNITED STATES PATENT AND TRADEMARK OFFICE

CERTIFICATE OF CORRECTION

PATENT NO. : 5,988,798

DATED : November 23, 1999

INVENTOR(S) : SHIN'ICHI HIRASAWA

It is certified that error appears in the above-identified patent and that said Letters Patent is hereby corrected as shown below:

COLUMN 7:

Line 14, "wail" should read --wall--.
Line 35, "election" should read --ejection-- and "referred" should read --referred to--; and
Line 37, "referred" should read --referred to--.

COLUMN 8:

Line 58, "gives" should be deleted.

COLUMN 10:

Line 1, "5" should be deleted;
Line 21, "with" should read --from--; and
Line 32, "FIG. 33" should read --FIG. 3B--.

COLUMN 11:

Line 45, "than" should read --than the--.

UNITED STATES PATENT AND TRADEMARK OFFICE

CERTIFICATE OF CORRECTION

PATENT NO. : 5,988,798

DATED : November 23, 1999

INVENTOR(S) : SHIN'ICHI HIRASAWA

It is certified that error appears in the above-identified patent and that said Letters Patent is hereby corrected as shown below:

COLUMN 12:

Line 4, "and" should read --is--;
Line 13, "in constructed" should read --is constructed--;
Line 50, "election" should read --ejection--;
Line 53, "She" should read --The--;
Line 54, "the" should read --an--;
Line 61, "spattering" should read --sputtering--; and
Line 64, "spattering" should read --sputtering--.

COLUMN 13:

Line 8, "circuitry" should read --circuitry of--;
Line 10, "are" should be deleted;
Line 22, "from" should read --from and projected on a side of--;
Line 36, "election" should read --ejection--; and
Line 42, "0.02" should read --0.02mm--.

COLUMN 14:

Line 41, "its" should read --their--; and
Line 43, "fifth" should read --the fifth--.

UNITED STATES PATENT AND TRADEMARK OFFICE

CERTIFICATE OF CORRECTION

PATENT NO. : 5,988,798

DATED : November 23, 1999

INVENTOR(S) : SHIN'ICHI HIRASAWA

It is certified that error appears in the above-identified patent and that said Letters Patent is hereby corrected as shown below:

COLUMN 15:

Line 65, "or" should read --of--.

COLUMN 16:

Line 40, "generate" should read --generated--; and
Line 64, "is" should read --ls--.

COLUMN 17:

Line 12, "spattering" should read --sputtering--;
Line 20, "length is" should read --length ls--;
Line 43, "8x10-9 $cm^3$." should read --$8x10^{-9}$ $cm^3$.--;
Line 49, "Is" should read --ls--;
Line 50, "is" should read --ls--;
Line 51, "is" (first occurrence) should read --ls--; and
Line 52, "is" (second occurrence) should read --ls--.

COLUMN 18:

Line 9, "resistance the" should read --resistance in the--;
Line 25, "is" should read --ls--;
Line 40, "FIG. 15A" should read --FIGS. 15A--;
Line 44, "is" should read --ls--;
Line 48, "is" should read --ls--;
Line 49, "is" should read --ls--;
Line 50, "is" should read --ls--; and
Line 59, "increases" should read --increase--.

UNITED STATES PATENT AND TRADEMARK OFFICE

CERTIFICATE OF CORRECTION

PATENT NO. : 5,988,798

DATED : November 23, 1999

INVENTOR(S) : SHIN'ICHI HIRASAWA

It is certified that error appears in the above-indentified patent and that said Letters Patent is hereby corrected as shown below:

COLUMN 19:

Line 3, "election" should read --ejection--;
Line 5, "election" should read --ejection--; and
Line 6, "election" should read --ejection--.

COLUMN 20:

Line 12, "elec-" should read --ejec---.

COLUMN 22:

Line 1, "area" (second occurrence) should be deleted; and
Line 45, "record" should read --recording--; and
Line 57, "$0.0015pvd^2/\eta$," should read --$0.015pvd^2/\eta$,--.

Signed and Sealed this

Third Day of April, 2001

Nicholas P. Godici

*Attest:*

NICHOLAS P. GODICI

*Attesting Officer*

*Acting Director of the United States Patent and Trademark Office*